US006671485B2

(12) United States Patent
Hirano

(10) Patent No.: US 6,671,485 B2
(45) Date of Patent: Dec. 30, 2003

(54) IMAGE FORMING APPARATUS

(75) Inventor: Kouji Hirano, Yokosuka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 8 days.

(21) Appl. No.: 10/024,345

(22) Filed: Dec. 21, 2001

(65) Prior Publication Data

US 2003/0118377 A1 Jun. 26, 2003

(51) Int. Cl.[7] ..... G03G 15/03
(52) U.S. Cl. ..... 399/284; 399/43; 399/53
(58) Field of Search ..... 399/284, 274, 399/43, 53

(56) References Cited

U.S. PATENT DOCUMENTS 3,152,012 A 10/1964 Schaffert
3,731,148 A 5/1973 Fournis

FOREIGN PATENT DOCUMENTS

JP 56-62275 * 5/1981
JP 6-130790 5/1994
JP 8-220964 * 8/1996
JP 2000-221776 8/2000

* cited by examiner

*Primary Examiner*—Quana M. Grainger
(74) *Attorney, Agent, or Firm*—Foley & Lardner

(57) ABSTRACT

An image forming apparatus is provided for using mono-component nonmagnetic toner, the image forming apparatus being capable of forming images with consistent quality without being influenced by variations in toner carry quantity and chargeability. More specifically, bias voltages are applied to a toner feed roller, developing roller and blade through a toner feed bias supply, development bias supply and blade bias supply, respectively. In this regard, the blade bias voltage is increased by a predetermined magnitude after a release of sleep mode of the fixing device until a predetermined number of image recording media have been imaged. Additionally, the blade bias voltage is decreased for a period of time corresponding to the first turn of the developing roller and increased for a period of time corresponding to the second or more turns thereof. In this manner, the blade bias voltage and the toner feed bias voltage are controllably changeable with a life or an increasing number of image formations.

31 Claims, 25 Drawing Sheets

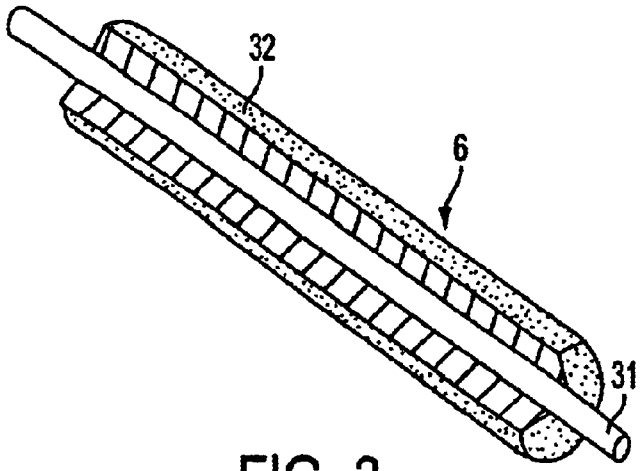
FIG. 3
FIG. 4a
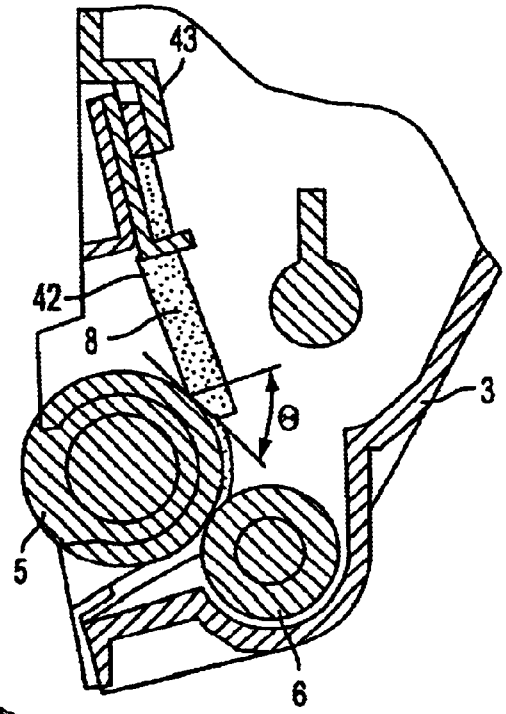
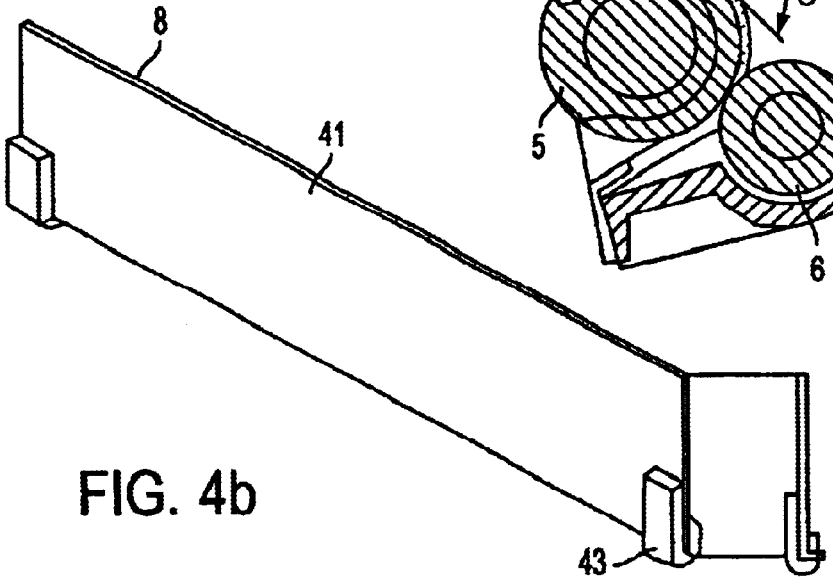
FIG. 4b

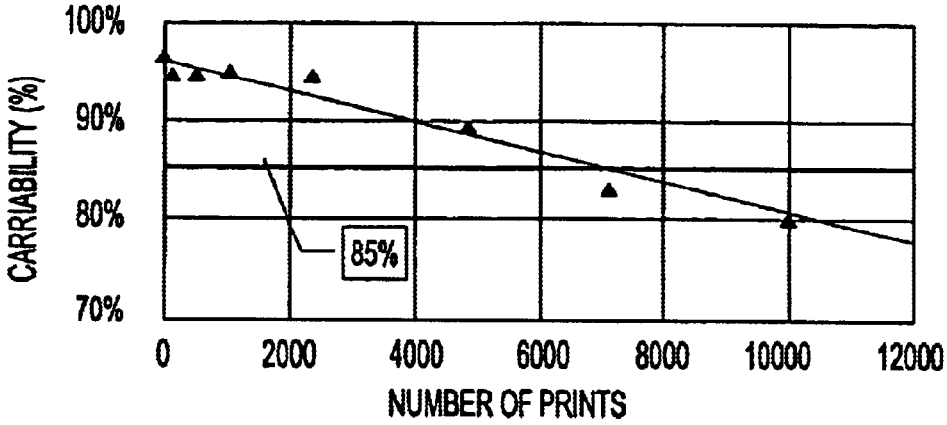
FIG. 6
| | INITIAL | AFTER 10,000 PRINTS |
|---|---|---|
| OUTER DIAMETER | 12.58mm | 11.85mm |
| RESISTANCE (SHAFT/ROLLER) | 54MΩ | 127MΩ |
| HARDNESS (ASKER-C) | 35° | 45° |
FIG. 7
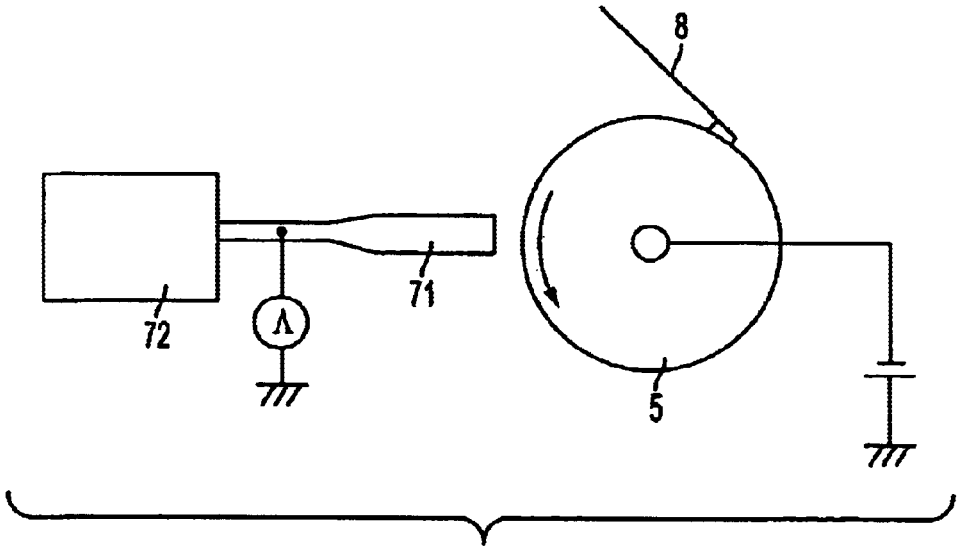
FIG. 8

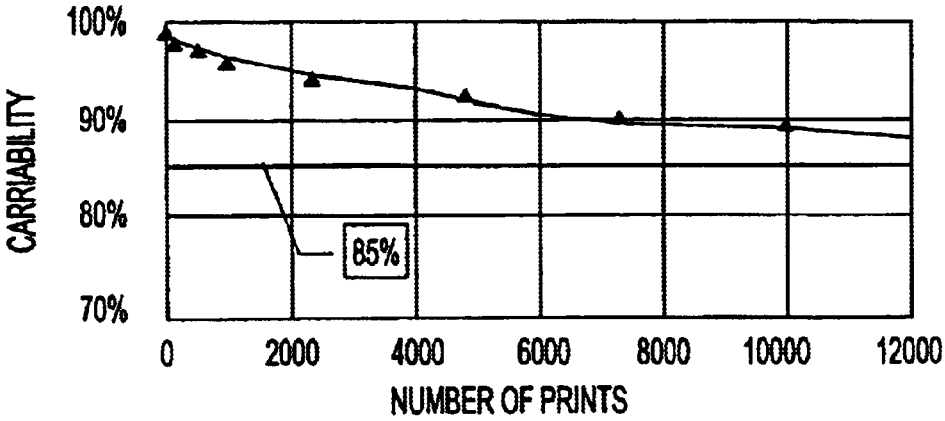
FIG. 9
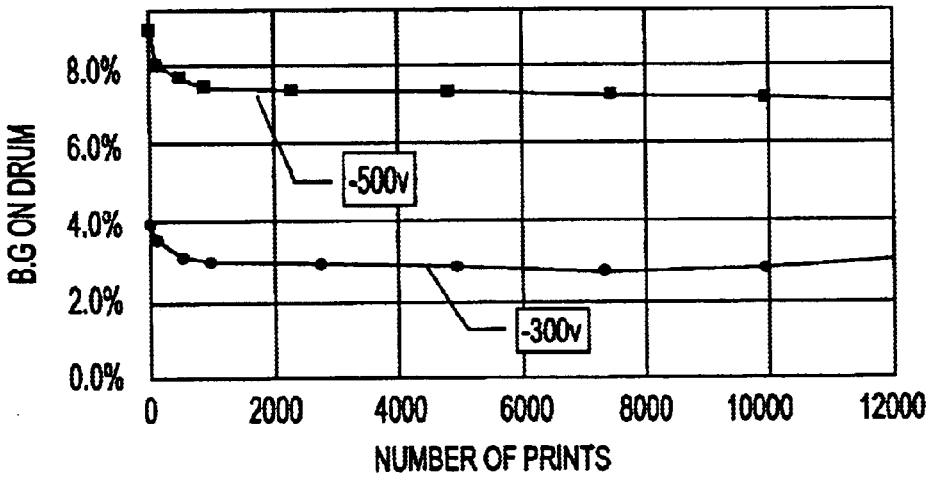
FIG. 10a
| TONER FEED BIAS | CHARGE QUANTITY (μ C/ g) |
|---|---|
| -300v | 8.45 |
| -500v | 4.29 |
FIG. 10b

| DIVISION | NUMBER OF PRINTS | TONER FEED BIAS VOLTAGE | BLADE BIAS VOLTAGE | SOLID IMAGE TONER CARRIABILITY | B.G ON DRUM | CHARGE QUANTITY (μ C/g) |
|---|---|---|---|---|---|---|
| ① | 0 | -300 | -450 | 98% | 2.9% | 8.9 |
| | 100 | ⇩ | ⇩ | 98% | 3.0% | 8.7 |
| | 500 | | | 97% | 3.1% | 8.6 |
| | 1,000 | | | 97% | 3.0% | 8.7 |
| | 2,500 | | | 96% | 3.1% | 8.7 |
| | 5,000 | | | 95% | 3.2% | 8.6 |
| ② | 5,001 | -400 | -550 | 98% | 3.0% | 8.7 |
| | 7,500 | ⇩ | ⇩ | 97% | 3.1% | 8.5 |
| | 10,000 | | | 95% | 3.2% | 8.6 |
| ③ | 10,001 | -450 | -600 | 97% | 3.1% | 8.6 |
| | 12,500 | ⇩ | ⇩ | 95% | 3.2% | 8.5 |
| ④ | 12,501 | -500 | -650 | 97% | 3.1% | 8.5 |
| | 15,000 | ⇩ | ⇩ | 95% | 3.3% | 8.4 |
| ⑤ | 15,001 | -550 | -700 | 96% | 3.2% | 8.4 |
| | 17,500 | ⇩ | ⇩ | 95% | 3.4% | 8.2 |
| ⑥ | 17,501 | -600 | -800 | 96% | 3.2% | 8.3 |
| | 20,000 | ⇩ | ⇩ | 95% | 3.4% | 8.2 |

FIG. 15

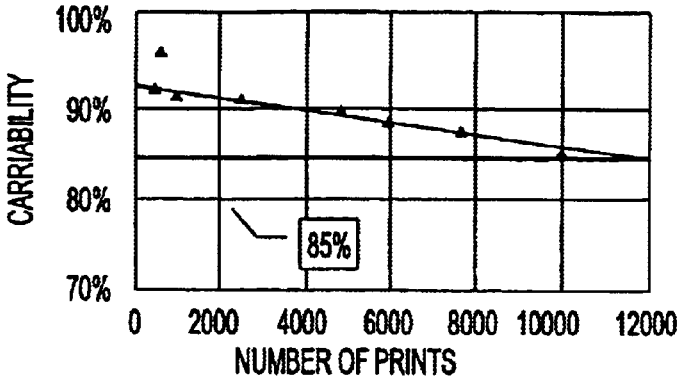
FIG. 17
| BLADE BIAS VOLTAGE | TONER LAYER THICKNESS ($mg/cm^2$) | EXISTENCE OF LEAKAGE |
|---|---|---|
| -500v | 0.60 | x |
| -450v | 0.58 | x |
| -400v | 0.57 | x |
| -350v | 0.58 | O |
| -300v | 0.59 | O |
| -250v | 0.57 | O |
| -200v | 0.58 | O |
FIG. 18
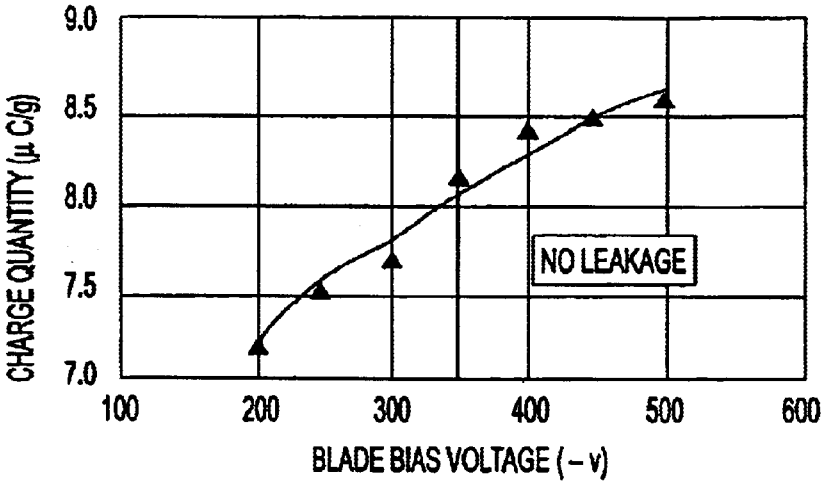
FIG. 19

| DIVISION | NUMBER OF PRINTS | BLADE BIAS VOLTAGE | SOLID IMAGE TONER CARRIABILITY | B.G ON DRUM | CHARGE QUANTITY (μ C/g) |
|---|---|---|---|---|---|
| ① | 0 | -400 | 92% | 2.9% | 8.9 |
| | 100 | ⇩ | 92% | 3.0% | 8.7 |
| | 500 | | 91% | 3.0% | 8.6 |
| | 1,000 | | 91% | 3.2% | 8.7 |
| | 2,500 | | 91% | 3.3% | 8.7 |
| ② | 2,501 | -350 | 91% | 3.1% | 8.9 |
| | 5,000 | ⇩ | 90% | 3.3% | 8.6 |
| | 7,500 | | 88% | 3.0% | 8.7 |
| ③ | 7,501 | -300 | 87% | 3.1% | 8.8 |
| | 10,000 | ⇩ | 86% | 3.2% | 8.6 |
FIG. 23
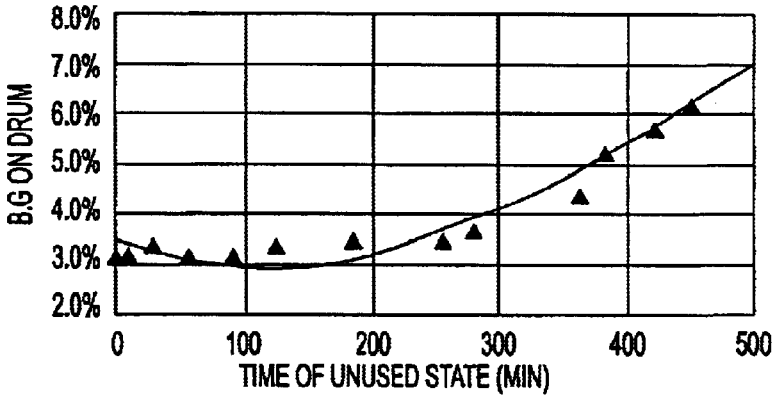
FIG. 24a
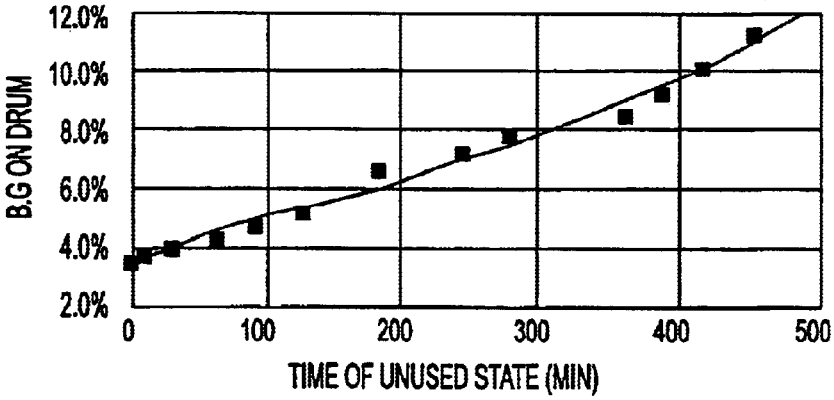
FIG. 24b

| TIME OF UNUSED STATE (MIN) | BLADE BIAS VOLTAGE | B.G ON DRUM | |
|---|---|---|---|
| | | ROOM TEMP & RH | HIGH TEMP & RH |
| 0 | -450 | 3.2% | 3.5% |
| 89 | ⇩ | 3.3% | 4.7% |
| 90 | -470 | 3.1% | 3.7% |
| 120 | ⇩ | 3.1% | 3.9% |
| 180 | | 3.1% | 4.4% |
| 181 | -500 | 2.9% | 3.6% |
| 240 | ⇩ | 3.1% | 3.8% |
| 269 | | 3.0% | 4.5% |
| 270 | -520 | 2.9% | 3.2% |
| 360 | ⇩ | 3.2% | 4.0% |
| 390 | | 3.5% | 4.4% |
| 419 | | 3.6% | 4.8% |
| 420 | -550 | 3.4% | 3.3% |
| 450 | ⇩ | 3.5% | 4.2% |

FIG. 25a

| TIME OF UNUSED STATE (MIN) | BLADE BIAS VOLTAGE | B.G ON DRUM | |
|---|---|---|---|
| | | ROOM TEMP & RH | HIGH TEMP & RH |
| 0 | -650 | 3.3% | 3.5% |
| 89 | ⇩ | 3.4% | 4.8% |
| 90 | -680 | 3.2% | 3.7% |
| 120 | ⇩ | 3.3% | 4.0% |
| 180 | | 3.3% | 4.5% |
| 181 | -700 | 3.1% | 3.5% |
| 240 | ⇩ | 3.2% | 3.9% |
| 269 | | 3.3% | 4.6% |
| 270 | -720 | 3.2% | 3.3% |
| 360 | ⇩ | 3.4% | 4.1% |
| 390 | | 3.5% | 4.4% |
| 419 | | 3.6% | 4.9% |
| 420 | -750 | 3.5% | 3.4% |
| 450 | ⇩ | 3.6% | 4.4% |

FIG. 25b

| NUMBER OF PRINTS | CHARGE QUANTITY (μ C/g) | | IMAGE DENSITY | |
|---|---|---|---|---|
| | FIRST TURN | SECOND TURN ET SEQ. | FIRST TURN | SECOND TURN ET SEQ. |
| 0 | 10.0 | 7.2 | 1.37 | 1.41 |
| 1000 | 10.3 | 7.1 | 1.37 | 1.41 |
| 2500 | 10.4 | 7.2 | 1.36 | 1.40 |
| 5000 | 10.2 | 7.0 | 1.38 | 1.41 |
| 7500 | 10.4 | 6.8 | 1.36 | 1.41 |
| 10000 | 10.5 | 6.7 | 1.35 | 1.42 |
| 12500 | 10.6 | 6.3 | 1.35 | 1.43 |
| 15000 | 10.4 | 6.1 | 1.37 | 1.44 |
| 20000 | 10.5 | 5.9 | 1.37 | 1.45 |

IMAGE FORMING APPARATUS

BACKGROUND OF THE INVENTION

1. Field of the Invention

The present invention relates to an electrophotographic-type image forming apparatus, which is applicable to a copier, printer, facsimile machine or any composite apparatus thereof and, more specifically, to an image forming apparatus of the type which uses mono-component nonmagnetic toner as a developer for image formation. Still more specifically, the invention relates to an image forming apparatus which is capable of producing images with consistent quality without being influenced by variations in toner carry quantity and chargeability by the application of a predetermined bias voltage to a toner layer forming blade.

2. Description of the Related Art

Electrophotography has been used extensively in a copier, a laser beam printer, etc. as a technology for printing images on a sheet of plain paper as image recording medium. Electrophotographic development can be roughly grouped into wet developing and dry developing, and generally the latter dry method is more popularly used. The dry development can be further grouped into two processes according to the type of developer or development agent to be used. One developer is two-component developer and the other is mono-component or mono-component developer, and the development using the latter mono-component developer is prevailing predominantly as the developing method mainly for small-size printers or copiers. Mono-component developer contains no carrier such as iron or ferrite powder and the developing apparatus using mono-component developer can be constructed simpler than that using two-component developer, thus offering advantages in terms of compactness and cost over the two-component counterpart.

Thus, mono-component development uses mono-component nonmagnetic developer for image formation. As a method of mono-component developing, impression development is known to those skilled in the art, in which the electrostatic latent image on a photosensitive drum and toner particles or toner carrier are brought into contact with each other such that the relative peripheral speeds therebetween are substantially zero. Such mono-component developing method is disclosed in U.S. Pat. No. 3,152,012, U.S. Pat. No. 3,731,148, Japanese Patent Application KOKAI Publication No. 47-13088 and Japanese Patent Application KOKAI Publication No. 47-13089. This mono-component developing method has many advantages; for example, it can dispense with carrier or magnetic material and, therefore, the developing apparatus and hence the image forming apparatus operable according to this method can be constructed simpler in structure and smaller in size and also it makes easier to use color toners.

As compared with the two-component development, however, the mono-component development is disadvantageous in terms of toner chargeability and toner carriability (or toner carry quantity) during operation immediately after a start-up of the image forming apparatus because the mono-component toner as the developer has no carrier which serves to charge the toner and to carry the toner onto the developing roller. Improvement of toner chargeability has been provided, for example, by Japanese Patent Application KOKAI Publication No. 6-130790 or Japanese Patent Application KOKAI Publication No. 2000-221776, which each proposes changing the material for a toner charging blade from plastic to metal and also applying a bias voltage to that toner charging blade (referred to as "blade biasing method").

According to the proposed blade biasing method, the effect of charge injection, as well as that of triboelectrification, are available, so that consistent toner charging can be accomplished. However, in this blade biasing method, a difference in toner chargeability is recognized between the leading end portion of an image and the remaining portion thereof, when the developing apparatus is used constantly and when the apparatus is used after a start-up following an idle or unused state thereof for a while. To be more specific, fogging toner appears increasingly in the background area in the above former case, while irregular image density in the solid area occurs in the latter case.

The above-cited KOKAI Publication No. 2000-221776 also discloses a technology of controllably changing the bias voltage for application to the toner layer forming blade in dependence on a change in cohesion of the mono-component toner which occurs due to toner deterioration with age or by a change of ambient humidity. According to this technology, an optimum toner layer can be formed on the developing roller by changing the bias voltage across the toner layer forming blade according to a change in the toner cohesion, with the result that good image formation can be maintained successfully. However, a problem of inconsistent image quality remains unsolved because the toner chargeability varies with an increasing number of prints.

SUMMARY OF THE INVENTION

The present invention has been made in view of the above-described problems. It is an object of the present invention to provide an image forming apparatus for using mono-component nonmagnetic toner, the image forming apparatus being capable of forming images with consistent quality without being influenced by variations in toner carry quantity and chargeability. More specifically, bias voltages are applied to a toner feed roller, developing roller and blade through a toner feed bias supply, development bias supply and blade bias supply, respectively. In this regard, the blade bias voltage is increased by a predetermined magnitude after a release of sleep mode of the fixing device until a predetermined number of image recording media have been imaged. Additionally, the blade bias voltage is decreased for a period of time corresponding to the first turn of the developing roller and increased for a period of time corresponding to the second or more turns thereof. In this manner, the blade bias voltage and the toner feed bias voltage are controllably changeable with a life or an increasing number of image formations.

In order to achieve the above objects, according to one embodiment of the present invention, an image forming apparatus is provided with a photosensitive member for forming thereon an electrostatic latent image, a developing roller for supplying mono-component nonmagnetic toner to visualize the latent image on the photosensitive member, a toner feed roller for feeding the toner to the developing roller, a blade for forming a layer of toner on the developing roller, a fixing device for fixing the visualized image on an image recording medium, and a blade bias voltage controllable means for applying a bias voltage to the blade and controllably changing the blade bias voltage at a time when a predetermined number of image recording media have been imaged after a start of operation of the fixing device following an idle state thereof continued for a predetermined period of time or longer.

According to one aspect of the present invention, the blade bias voltage is higher during the period of time before the predetermined number image recording media imaged than that after this period of time.

According to another aspect of the present invention, the idle state of the fixing device is accomplished by sleep mode setting thereof and the start of operation of the fixing device is effected by terminating the sleep mode setting.

According to another aspect of the present invention, a life-dependent blade bias voltage controllable means is provided for controllably changing a bias voltage for application to the toner feed roller, as well as the bias voltage for application to the blade, in response to a life or an increase in the number of image recording media formed with images.

According to another aspect of the present invention, the bias voltage for application to the blade is increased with an increase in the bias voltage for application to the toner feed roller.

According to another aspect of the present invention, the absolute value of the bias voltage for application to the blade is lower than that of the bias voltage for application to the developing roller.

According to another aspect of the present invention, the life-dependent blade bias voltage controllable means is operable to controllably change the bias voltage for application to the blade in response to the number of turns of the developing roller.

According to another aspect of the present invention, the life-dependent blade bias voltage controllable means is operable to detect a change in physical characteristics of the toner feed roller based on the value of an electrical resistance thereof and to controllably change the bias voltage for application to the blade based on a change in the electrical resistance value.

According to another aspect of the present invention, the life-dependent blade bias voltage controllable means is operable to controllably change the bias voltage for application to the toner feed roller and the bias voltage for application to the blade on the basis of an accumulated running distance of the photosensitive member.

According to another embodiment of the present invention, an image forming apparatus is provided with a photosensitive member for forming thereon an electrostatic latent image, a developing roller for supplying mono-component nonmagnetic toner to visualize the latent image on the photosensitive member, a toner feed roller for feeding the toner to the developing roller, a blade for forming a layer of toner on the developing roller, a fixing device for fixing the visualized image on an image recording medium, and a blade bias voltage controllable means for controllably changing a bias voltage for application to the blade at a time when the developing roller has made a predetermined number of turns after a start of operation of the fixing device following an idle state thereof continued for a predetermined period of time or longer.

According to one aspect of the present invention, the predetermined number of turns is one turn.

According to another aspect of the present invention, the bias voltage for application to the blade is higher during the period of time before the developing roller has made the predetermined number of turns than that applied after this period of time.

According to another aspect of the present invention, means for detecting the running distance of the photosensitive member and determining the number of turns of the developing roller based on the detected running distance is provided, wherein the blade bias voltage controllable means is operable to controllably change the blade bias voltage based on the determined number of turns.

According to yet another embodiment of the present invention, an image forming apparatus is provided with a photosensitive member for forming thereon an electrostatic latent image, a developing roller for supplying mono-component nonmagnetic toner to visualize the latent image on the photosensitive member, a toner feed roller for feeding the toner to the developing roller, a blade for forming a layer of toner on the developing roller, a fixing device for fixing the visualized image on an image recording medium, and blade bias voltage controllable means for applying a bias voltage to the blade, controllably changing the bias voltage for application to the blade at a time when a predetermined number of image recording media have been imaged after a start of operation of the fixing device following an idle state thereof continued for a predetermined period of time or longer, and controllably changing the bias voltage for application to the blade about at a time when the developing roller has made a predetermined number of turns after a start of operation of the fixing device following an idle state thereof continued for a predetermined period of time or longer.

According to one aspect of the present invention, the blade bias voltage controllable means is operable to increase the bias voltage for application to the blade after the developing roller has made the predetermined number of turns and also to decrease the bias voltage for application to the blade after the predetermined number of image recording media has been formed with image.

According to another aspect of the present invention, the bias voltage for application to the toner feed roller is controllably changed with an increase in the number of prints and the bias voltage for application to the blade is also controllably changed with an increase in the number of prints, so that the toner charge quantity can be stabilized and image quality can be stabilized accordingly.

According to another aspect of the present invention, the blade bias voltage, as well as the toner feed roller bias voltage, is increased in response to a life, so that the toner charge quantity can be stabilized, which helps to reduce fogging on the photosensitive member.

According to another aspect of the present invention, in view of the phenomenon that leakage occurs due to the difference between the voltage applied to the developing roller and that applied to the blade when the toner carry quantity is reduced, the absolute value of the bias voltage for application to the blade (e.g. −350 V) is set lower than that of the bias voltage for application to the developing roller (e.g. −500 V). By so doing, leakage can be successfully prevented.

According to another aspect of the present invention, by establishing a relationship between the toner feed bias voltage and the developing bias voltage as |toner feed bias voltage|≧|developing bias voltage|, the toner supplied to the developing roller from the toner feed roller is subjected to triboelectric charging and, therefore, the toner is carried to the blade under the influence of electrostatic force, physical force and potential difference. The common voltage source for supplying the same bias voltage to the toner feed roller and to the developing roller helps simplify the image forming apparatus and its relevant peripheral circuits, and the controlling operation of the apparatus.

According to another aspect of the present invention, the blade bias voltage is increased by a predetermined magnitude at early stage of image forming operation, so that good image with consistent quality with little fogging can be produced.

A difference in charge quantity occurs due to rotation of the developing roller immediately after a start-up of the image forming operation, resulting in irregular image density. However, according to an aspect of the present invention, the blade bias voltage is controllably changed during the early period of rotation of the development roller so that the charge quantity difference is limited to realize consistent image density.

According to one aspect of the present invention, the blade bias voltage is so controlled that the blade bias voltage is changed during the early period of operation immediately after releasing the sleep mode setting of the fixing device, as well as changing the bias voltage during early rotation of the developing roller. This makes it possible to perform stabilized image formation from the early period of operation and even with the number of prints being increased.

Furthermore, irregularity in image density may occur due to a charge quantity difference occurring between the first turn and the subsequent second turn of the developing roller. However, according to one aspect of the present invention, the blade bias voltage for the first turn of the developing roller is decreased and the voltage is increased for the second and the following turns thereof so that the charge quantity difference can be limited to realize consistent image density.

The required difference in the bias voltages for application to the developing roller and the blade should differ in dependence on the number of prints made. As a method of changing the blade bias voltage in the first turn and the second and the following turns of the developing roller, therefore, it may be so controlled that the blade bias voltage is changed when the number of prints made which is represented by the accumulated running distance of the photosensitive drum has reached a predetermined value.

Alternatively, according to one aspect of the present invention, the blade biasing means can change the blade bias voltage in accordance with a value of voltage applied to the toner feed roller which may be detected by using a conductive brush or thin metal plate disposed in contact with the toner roller feeding roller surface.

Furthermore, according to one aspect of the present invention, the running distance of the photosensitive drum can be calculated by counting the number of rotations of the photosensitive drum by means of an encoder. This can eliminate a contact device such a conductive brush as described above, which may cause damage to the toner feed roller.

BRIEF DESCRIPTION OF THE DRAWINGS

FIG. 3 is a cutaway view showing the interior of a toner feed roller 6 shown in FIG. 1;

FIG. 4*a* is an enlarged view showing parts including a blade in FIG. 1;

FIG. 4*b* is a perspective view of the blade;

FIG. 6 is a graph showing the toner carriability varying with an increase in the number of prints;

FIG. 7 is a table showing major physical characteristics of a toner feed roller 6, comparing changes between such characteristics immediately after an initial printer start-up and after the completion of 10,000 prints;

FIG. 8 is a schematic diagram illustrating a method of measuring the toner carry quantities;

FIG. 9 is a graph showing the toner carriability varying with a life when the voltage applied to the toner feed roller is changed;

FIG. 10*a* is a graph showing an improvement in reduction of fogging on a photosensitive drum;

FIG. 10*b* is a table showing an improvement in toner charge quantity after making a predetermined number of prints;

FIG. 15 is a table providing data or results from experiment of making 20,000 prints while controlling the blade bias voltage;

FIG. 17 is a graph showing the toner carriability varying with an increase in the number of prints in the development apparatus according to the embodiment of FIG. 16;

FIG. 18 is a table providing data from checking for leakage under varying conditions of blade bias voltage in the development apparatus according to the embodiment of FIG. 16;

FIG. 19 is a characteristic graph showing the charge quantity varying with an increase in the blade bias voltage in the development apparatus according to the embodiment of FIG. 16;

FIG. 23 a table providing data or results from experiment of making 10,000 prints while controlling the blade bias voltage in the development apparatus according to the embodiment of FIG. 16;

FIGS. 24*a* and 24*b* provide two characteristic graphs showing data about the relationship between idle or unused time of the image forming apparatus and the fogging appearing on the photosensitive drum, wherein FIG. 24*a* provides data obtained by experiment under a normal environment of room temperature, while FIG. 24*b* under 30° C. and 85% RH;

FIG. 25*a* is a table showing the relationship between the blade bias voltage and fogging when 500 prints have been made;

FIG. 25*b* is a table showing the relationship between the blade bias voltage and fogging when 15,000 prints have been made;

FIGS. 34*a* and 34*b* show timing charts in printing operation according to the second embodiment of the invention having only the function of stepping up the blade bias voltage by a predetermined magnitude after a release of the sleep mode of the fixing device until a predetermined number of prints has been made, wherein FIG. 34*a* shows timing charts at the early stage of printing operation, and FIG. 34*b* timing charts under a state where the printer is left in an idle state thereof for about six hours after making 10,000 prints;

FIGS. 35*a* and 35*b* are timing charts in case where the apparatus has only the function of adjusting the toner charge quantity in the first turn of the developing roller and the second and the following turns thereof, wherein FIG. 35*a* shows a timing chart at the early stage of printing operation, and FIG. 35*b* a timing chart under a state where the printer is left in an idle state thereof for about six hours after making 10,000 prints;

DESCRIPTION OF THE PREFERRED EMBODIMENTS

Figure 1:
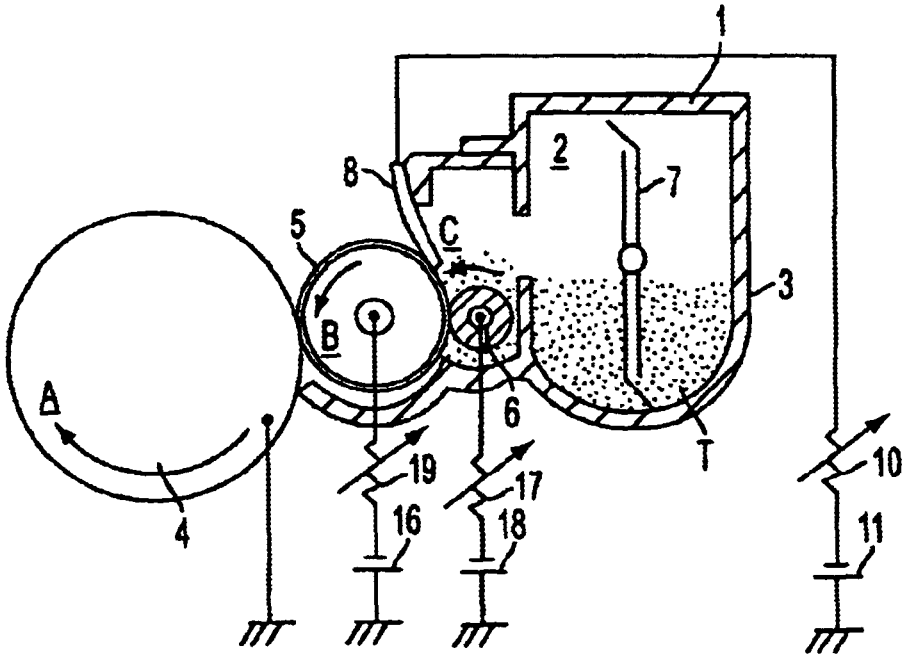
FIG. 1 is a schematic representation showing a developing apparatus using a mono-component nonmagnetic type developer, as used in an image forming apparatus such as PPC (plain paper copier), laser beam printer, etc. constructed according to an embodiment of the present invention.

The following will describe preferred embodiments of an image forming apparatus constructed according to the present invention with reference to the accompanying drawings. Referring to FIG. 1, there is shown a schematic representation of a developing apparatus using a mono-component nonmagnetic type developer and applicable to an image forming apparatus such as PPC (plain paper copier), laser beam printer, etc. In this figure, the developing apparatus is designated generally by reference numeral 1 and includes a toner container 3 constructed integrally with the developing apparatus 1 and defining therein a toner storage receiver 2 in which nonmagnetic mono-component toner T as a developing agent is stored. The developing apparatus 1 further includes a photosensitive drum 4 serving as an image carrier of the image forming apparatus and supported rotatably in the arrow direction A, and a developing roller 5 located adjacent to an opening region of the toner container 3. The developing roller 5 is disposed in elastic contact with the photosensitive drum 4 so as to form a width of nip therebetween and supported rotatable in the arrow direction B that is opposite to the rotational direction A of the photosensitive drum 4.

Provided behind the developing roller 5 and at the bottom of the toner storage receiver 2 is a toner feed roller 6 serving as a developer feed roller for feeding or supplying toner T in the toner storage receiver 2 onto the developing roller 5. This toner feed roller 6 is so disposed that it is brought into contact with the developing roller 5 with a predetermined depth of penetration at the nip therebetween. In the illustrated embodiment, the penetration depth between the two rollers 6 and 5 is set to about 0.5 mm, although it is noted that the penetration depth may be changed as required according to the torque required to drive the developing roller 5 and the magnitude of toner feed bias voltage which will be discussed more in detail in later part hereof.

The toner feed roller 6 is rotatable in the same direction as the developing roller 5, as indicated by arrow C, to feed toner T in the toner storage receiver 2 onto the developing roller 5 at the bottom of the developing apparatus 1. The toner container 3 has therein a mixer 7 for agitating and moving the toner T within the toner storage receiver 2.

The developing apparatus 1 further includes a blade 8 located in contact with the developing roller 5 for regulating the toner carry quantity fed by the developing roller 5 thus forming a thin layer of toner T on the peripheral surface of the developing roller 5. Though not shown in the drawing, there is also provided a recovery blade (e.g. Mylar film) disposed in contact with the surface of the developing roller 5 at a position adjacent the bottom region of the roller 5.

The blade 8 may be made of a thin metal spring plate with a thickness t of about 0.05 to 0.5 mm and a predetermined length with one end thereof fixed to the developing apparatus 1. The blade 8 is connected to a bias voltage source 11 by way of a variable-voltage device 10 so that a bias voltage having a predetermined magnitude is applied to the blade 8.

Similarly, the toner feed roller 6 is connected to a bias voltage source 18 through a variable-voltage device 17 and the developing roller 5 is also connected to a bias voltage source 16 through a variable-voltage device 19 so that predetermined toner feed bias voltage and developing bias voltage can be applied to the rollers 6 and 5, respectively.

With such an arrangement, the toner T being mixed or agitated by the mixer 7 in the container 3 is supplied to the toner feed roller 6, which in turn feeds the toner T to the developing roller 5. Bias voltages are applied to the toner feed roller 6 and the developing roller 5, respectively, wherein the relationship therebetween can be expressed by |toner feed bias|≧|developing bias|. When the toner T is being fed to the developing roller 5 by the toner feed roller 6, triboelectric charging occurs between the toner feed roller 6 and the developing roller 5, so that the toner is carried toward the blade 8 under the actions of static electricity, potential difference and physical force.

Toner T on the developing roller 5, the amount of which is being limited by the blade 8, is electrically charged under the influence of charge injection from the blade bias voltage 11 applied to the blade 8 and of triboelectric charging, wherein the relation between the blade bias and developing voltages can be expressed by |blade bias|≧|developing bias|. After moving past the blade 8, the toner T is charged sufficiently and a uniform layer of toner is formed on the developing roller 5. Since the image forming apparatus in the illustrated embodiment is designed to operate by reversal development process using a photosensitive drum of negative-charge type organic photoreceptor (OPC), the toner T is negatively charged.

The developing roller 5 and the photosensitive drum 4 are disposed such that they are pressed against each other on the basis of a predetermined load so that about 1.5 mm of width of contact (or developing nip) is provided. The developing nip should range preferably between 0.5 mm and 4.0 mm and, if the nip is more than 4.0 mm, part of the toner tends to be adhered on the background portion on the photosensitive drum 4, thereby causing fogging. Part of the toner T moving past the developing nip, but not contributing to image development, is recovered by the recovery blade (not shown) and returned into the toner storage receiver 2.

The following will specifically describe the developing roller 5 used in the illustrated embodiment according to the present invention. Since the developing apparatus of the illustrated embodiment is characterized in that the developing roller 5 and the photosensitive drum 4 are disposed in pressing contact with each other, it is necessary to use an elastic roller for the developing roller 5. Although it is possible that the photosensitive member is made of a belt or the like and the developing roller 5 is made of a metal, such an arrangement would cause the apparatus structure to be complicated and hence expensive, i.e., unrealistic. Additionally, it is necessary to carry the toner T with certainty to the development position on the photosensitive drum 4. For this purpose, the developing roller 5 is required to have characteristics, such as proper elasticity and a relatively smooth surface, and an appropriate electrical resistance should exist between the developing roller 5 and a metal core shaft.

Figure 2:
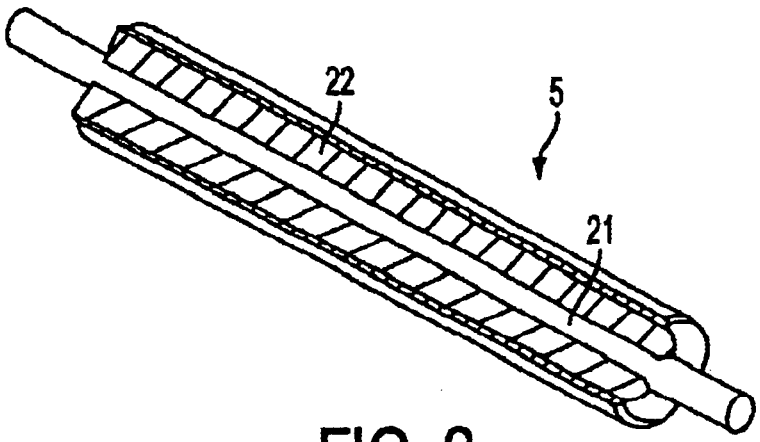
FIG. 2 is a cutaway view showing the interior of a developing roller 5 shown in FIG. 1.

To fulfill such requirements, the developing roller 5 according to the present embodiment, the interior section thereof being shown in FIG. 2, includes an elastic semi-conducting layer 22 attached onto the metal core shaft 21, which layer has a dielectric constant of about 10 and has the peripheral surface thereof ground to a fine finish. The elastic semi-conducting layer 22 of the developing roller 5 may be made from an electrical resistance adjusting resin such as a dispersion mixture of a resin selected from EPDM (ethylene propylene diene monomer), urethane, silicon, nitrile butadiene rubber, chloroprene rubber, styrene butadiene rubber, butadiene rubber and conductive fine particles including either one or both of carbon and titanium oxide ($TiO_2$) as the electrical resistance adjusting agent. Alternatively, the above conductive particles may be replaced by inorganic ionic conductive material including, for example, one or more of sodium perchlorate, calcium perchlorate, sodium chloride, etc.

To impart elasticity to the elastic layer 22, mixing/foaming process may be used and, as a suitable foaming agent for the process, a silicon-based surfactant such as polydiallyl siloxane, polysiloxane-polyalkylenoxide block copolymer, etc. is preferred. As an example of foaming process to form the elastic layer 22, heat blow molding process may be employed, according to which a mixture of the above silicon-based surfactants in a suitable mixture ratio is agitated and then injected into an extrusion molding die and heated under 80° C. to 120° C. preferably for about 5 to 100 minutes before ejection. To mold the elastic layer member 22 integrally round the metal core shaft 21, the shaft 21 is placed centrally in a molding die and the above mixture of surfactants is poured into the die and heated for about 10 to 160 minutes for vulcanization, thus the developing roller 5 with an integral structure being produced.

The above-mentioned carbon black for use as electrical resistance adjusting material for the developing roller 5 should have such physical properties as nitrogen absorption specific surface area ranging from 20 to 130 $m^2/g$ and DBP oil absorption ranging from 60 to 120 ml/g (for example, ISAF, HAF, GPF and SRF), and such carbon is mixed with polyurethane at a rate of 0.5 to 70 weight parts to 100 weight parts of the polyurethane. Incidentally, DBP absorption is a method to determine the carbon black microstructure such as surface area thereof, and this method is generally utilized in evaluating oil wettability of carbon black.

As the polyurethane to be mixed with carbon black, soft polyurethane foam or polyurethane elastomer is preferred. Alternatively, EPDM, urethane, silicon, nitrile butadiene rubber, chloroprene rubber, butadiene rubber are usable. It is noted that EPDM is an appropriate mixture containing ethylene, propylene and a termonomer such as dicyclopentadiene, ethylidene norbornene, 1,4 hexadiene, etc. and, therefore, when this EPDM is used instead of polyurethane as the major component of the developing roller 5, it is preferred that 50 to 95 weight parts of ethylene, 5 to 95 weight parts of propylene and 0 to 50 weight parts of iodine number as the termonomer should be mixed. Good dispersion can be achieved by using a mixture of 1 to 30 weight parts of carbon black with respect to 100 weight parts of EPDM. As the carbon black to be used with EPDM, the aforementioned ISAF, HAF, GPF and SRF are preferred.

Furthermore, uniform dispersion can be accomplished by mixing 0.1 to 10 weight parts of ionic conductive substance such as sodium perchlorate, tetraethyl ammonium chloride as the electrical resistance adjusting base material or the same weight parts of the surfactant such as dimethyl polysiloxane, polyoxyethylene lauryl ether, together with the carbon black as the electrical resistance adjusting material, with respect to 100 weight parts of EPDM.

The above ionic conductive material may include inorganic ionic conductive substances such as sodium perchlorate, calcium perchlorate, sodium chloride, or organic ionic conductive substance such as modified aliphatic dimethylethyl ammonium ethosulfate, stearin ammonium acetate, lauryl ammonium acetate, octa desil trimethyl ammonium perchlorate. It is noted that one or more of the above substances may be used for the mixing.

In the preferred embodiment, the metal core shaft 21 has an outer diameter of about 10 mm, and the shaft 21 is clad with a layer of silicon rubber having an outer diameter of about 18 mm and using carbon black as the electrical resistance adjusting agent. Bias voltage is applied to the metal core shaft 21. By so constructing, the developing roller 5 has an electrical resistance of about $5\times10^6$ between its metal core shaft 21 and the roller surface, a hardness of 65 Asker C, and average surface roughness Rz of 3 $\mu$m as measured at ten different points in accordance with JIS (Japanese Industrial Standard) B 0601.

Referring now to FIG. 3, the toner feed roller 6 used in the illustrated embodiment will be explained. As mentioned earlier, the toner feed roller 6 should preferably made of an elastic material such as foamed elastomer so as to permit engagement of the toner feed roller 6 in contact with the developing roller 5 with an appropriate amount of elastic deformation at the nip therebetween and also make possible consistent toner feeding operation. Additionally, since bias voltage is applied to the toner feed roller 6 through its metal core shaft, the roller 6 should preferably be electrically conductive. For these purposes, the toner feed roller 5 in the illustrated embodiment is constructed, as shown by the inner section of the toner feed roller 6 in FIG. 3, to include a metal core shaft 31 having an outer diameter of about 6 mm and clad with an electrically conductive urethane foam 32 with a cell density of 80 to 100 pores per inch and such a thickness that the outer diameter of the resulting toner feed roller 5 becomes about 12.5 mm. As indicated above, the core shaft 31 is connected to the bias voltage source for application of bias voltage thereto. By so constructing, the resulting toner feed roller 6 has a resistance of about $5\times10^7$ between its metal core shaft 31 and the roller surface and a hardness of 40 Asker C.

Then, the blade 8 used in the present embodiment will be described in the following. As indicated earlier, the blade 8 is of a predetermined length and has one end thereof fixed to the developing apparatus 1 and the other free end thereof pressed against the developing roller 5 with a predetermined pressure. In view of application of bias voltage to the blade 8, it is made of any suitable metal spring plate with a thickness t from about 0.05 to 0.5 mm. Thus, the blade 8 is elastically deformable due to its spring characteristic and it is resiliently pressed at its free end against the peripheral surface of the developing roller 5 with a predetermined pressure so as to properly regulate the formation of the desired thickness of toner layer and to generate the desired quantity of toner charge.

The blade 8 is shaped in such a way that its free end portion adjacent to the developing roller 5 may be bent away from the surface of the developing roller 5 and has at its tip end a beveled surface which is inclined slightly in the direction in which an angle made between the developing roller 5 and the bent blade 8 is widened. As the metal plate for the blade 8, a material having a spring property is generally used. For example, spring steel SUS, stainless steel such as SUS 301, SUS 304, SUS 420J2, SUS 631, or alloyed steel such as C 1700, C 1720, C 5210, C 7701 may be employed. The above-mentioned beveled surface at the free tip end of the blade 8 may be formed by machining, grinding, bending or, alternatively, a separate tip member formed previously so as to have the desired bevel angle may be attached to the blade 8 by using any suitable electrically conductive adhesive.

Referring to FIGS. 4*a* and 4*b* showing an enlarged view including the blade 8 of FIG. 1 and a perspective view thereof, respectively, the blade 8 in the illustrated embodiment is made of a stainless steel plate 41 with a thickness of about 0.15 mm and a free length of about 13 mm. The blade 8 is held by a hook 43 in a cantilever fashion with the free end thereof placed in pressing contact with the developing roller 5, and the blade 8 has an inclined portion 42, which extends away from the developing roller 5 after the extreme end thereof has bore against the developing roller 5. Thus, the blade 8 is bent in an angled shape as shown in FIG. 4*a*.

In the illustrated embodiment, the inclined portion 42 of the bent blade 8 is set at an angle of about 65° as indicated in FIG. 4*a* and it is so adjusted that the blade 8 is pressed against the peripheral surface of the developing roller 5 with a pressure of about 20 gf/cm$^2$. Under the aforementioned conditions, a nip width of about 1.0 mm may be formed between the developing roller 5 and the blade 8.

The following will describe the toner used in the illustrated embodiment. A mono-component nonmagnetic toner as the developer may be made from a mixture which contains 80 to 90 weight parts of styrene-acrylic copolymer, 5 to 10 weight parts of carbon black and 0 to 5 weight parts of charge controlling agent. Such mixture is agitated, kneaded, crushed and then classified to obtain a negatively chargeable toner with the desired average particle size of about 5 to 10 $\mu$m. To improve the toner fluidity, 0.5 to 1.5 weight parts of silica ($SiO_2$) is added internally or externally, thus providing a mono-component nonmagnetic developer. It is noted that the toner T as the mono-component nonmagnetic developer is not limited to the above materials, but the following compositions are applicable to the developing apparatus of the present invention.

Besides the above-mentioned major component of styrene-acrylic copolymers as the thermoplastic binder resin, polystyrene, polyethylene, polyester, low molecular weight polypropylene, epoxy, polyamide, polyvinyl butyral may be used. In case of a black toner, various colorants may be used such as furnace black, nigorosine dye and metallized dye, as well as the carbon black.

As color toners, benzidine-type yellow pigments, Fanon yellow, acetoacetanilide-type insoluble azo pigment, monoazo pigment, azomethine-type dye as yellow colorant; xanthene-type magenta dye, phosphor and tungsten molybdate lake pigment, anthraguinone-type dye, colorant composed of xanthen-type dye and organic carboxylic acid, thioindigo, naphthol-type insoluble azo pgiment for magenta colorant; and steel phthalocyanine-type pigment for cyan colorant. Additionally, as an agent for improving the toner fluidity, colloidal silica, titanium oxide, alumina, zinc stearate, polyvinylidene fluoride, or mixtures of these substances, as well as externally added silica, may be used. Furthermore, as an agent for controlling the toner chargeability, azo-type metal complex salt and chlorinated paraffin are usable.

The developing apparatus thus constructed according to the present embodiment was incorporated in a laser printer by way of example, and testing thereof was conducted. For the testing conditions, the process speed was set at about 87 mm/second, a negative charging type OPC with about 30 mm diameter was used as the photosensitive drum, and the number of rotations of the developing roller 4 was set to rotate at a speed of 130 mm/second (i.e., about 1.5 times as high as that of the photosensitive drum). The surface potential of the photosensitive drum was set at −600 volts(V), the bias voltage for application to the developing roller 5 at −200 V, the bias voltage for application to the toner feed roller 6 at −300 V, and the bias voltage for application to the blade 8 at −450 V, respectively.

Figure 5:
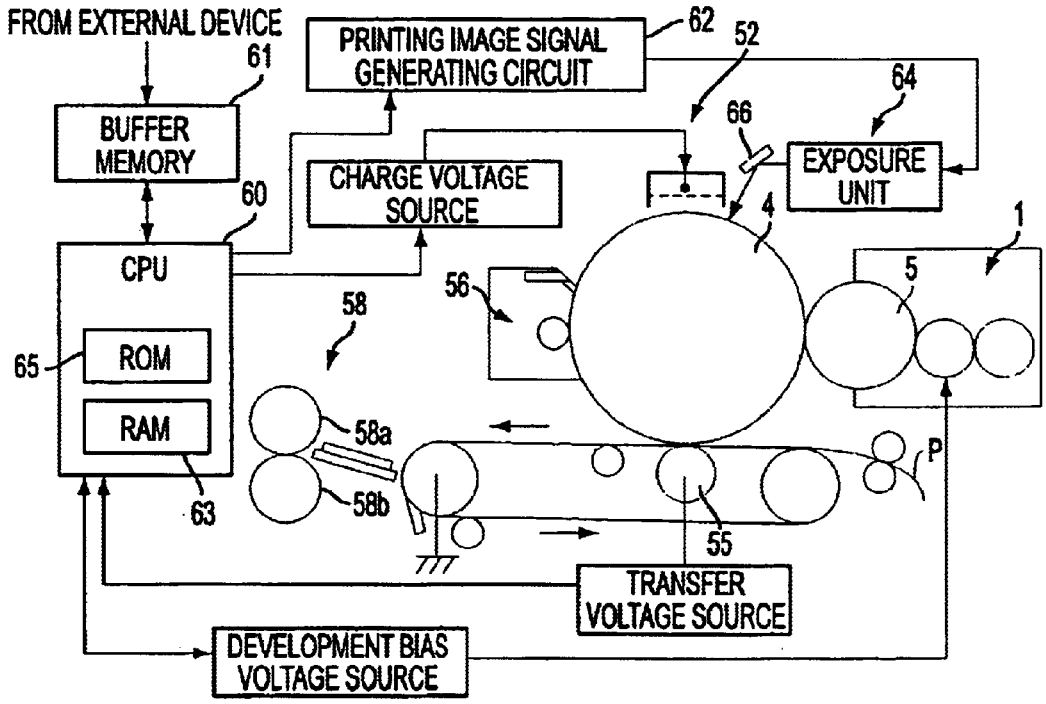
FIG. 5 is a schematic illustration of the overall arrangement of the image forming apparatus of the present invention.

The following will now describe the operation of the printer having incorporated therein the developing apparatus of FIG. 1. FIG. 5 is a schematic illustrative diagram showing the overall arrangement of the image forming apparatus of the present invention. Turning on a power switch not shown in the drawing, the image forming apparatus shown in FIG.5 is started for warm-up operation. To be more specifically, the heater (not shown) of a fixing device (fixer) 58 is activated and its fixing rollers 58*a*, 58*b* are heated accordingly until the temperature on the peripheral surfaces thereof reaches a predetermined level.

Subsequently, a main motor (not shown) of the image forming apparatus is started to drive the photosensitive drum 4 to rotate at a predetermined peripheral speed of about 87 mm/second. At this time, a predetermined voltage (surface potential) is applied to the surface of the photosensitive drum 4 by an electrostatic charging device or charger 52 at a predetermined timing. Simultaneously, a bias voltage having polarity reverse to that of the above predetermined voltages is applied to each of the developing roller 5 of the developing apparatus 1, the toner feed roller (not shown) disposed in the not shown housing, and the blade (not shown), respectively, and the developing roller 5 is driven to rotate at the predetermined speed.

As the charged area on the photosensitive drum 4, which has been charged to the predetermined voltage by the charger 52, reaches such a position where it faces the developing roller 5, the bias voltages applied to the developing roller 5, toner feed roller (not shown) and blade (not shown) are changed to predetermined levels, respectively. Thus, the surface potential of the photosensitive drum 4 is stabilized or aged. As the surface potential of the photosensitive drum 4 has been stabilized and the temperature of the fixing device 58 has reached a predetermined level by such warming-up operation, a not shown external device is enabled to input a print-start command.

Subsequently, a record-start command is provided from an external device (not shown) at an appropriate timing and if print data transmission is permitted by CPU 60, the print data is transmitted to a buffer memory 61 from an external device (not shown). The print data fetched in the buffer memory 61 is image processed in RAM 63. Light intensity of laser beam emitted by a semiconductor laser device (not shown) of an exposure unit 64 is converted into image data corresponding to the image pattern, which is in turn supplied to a printing image signal generating circuit 62 serving as a record beam generating circuit.

Then, the printing image signal generating circuit 62 operates to change the intensity of the laser beam emitted from the semiconductor laser device of the exposure unit 64 in correspondence to the image data so that the electric charge of the photosensitive drum 4 charged previously to predetermined surface potential level is selectively attenuatable to a desired level. The laser beam emitted from the exposure unit 64 is reflected on an exposure mirror 66 and exposed to a given area on the surface of the photosensitive drum 4. The photosensitive drum 4, which is charged to the aforementioned predetermined surface potential (i.e. −600 V in the illustrated embodiment) by the charger 52 before the laser beam with its intensity changed in accordance with the image data is emitted, has its surface potential selectively attenuated in accordance with the supplied image data, and an electrostatic latent image corresponding to the image data is formed and carried on the photosensitive drum 4.

The electrostatic latent image formed on the peripheral surface of the photosensitive drum 4 is then visualized as a toner image with the toner fed from the developing apparatus 1. When a transfer bias voltage is applied to a transfer device 55 at an appropriate time, the toner image is transferred by the transfer device 55 onto an image recording medium in a paper cassette (not shown) or a manual paper feeder (not shown). The toner image transferred onto the image recording medium by the transfer device 55 is separated from the photosensitive drum 4 together with the image recording medium, and the image recording medium is moved toward the fixing device 58 and guided between the fixing rollers 58*a*, 58*b* of the fixing device 58. The toner image guided into the fixing device 58 is fixed on the medium recording medium by the action of heat and pressure applied from the fixing rollers 58*a*, 58*b*. Then, the image-recording medium is ejected out of the image forming device.

After the toner image has been transferred to the image recording medium, the photosensitive drum 4 undergoes cleaning to remove residual toner left on the peripheral surface of the photosensitive drum 4 by means of a drum cleaner 56 for reuse in the next image forming process. When the image forming operation is performed repeatedly for two or more times, a series of the aforementioned operations is repeated for the required number of times. The charger 52 may generally employ such a system as corona charging using discharging wire, roller charging using elastic roller, or brush charging using a conductive brush. As the transfer device 55, a transfer roller using conductive elastic roller and a transfer belt are popularly used.

Results from print testing conducted with the above-described image forming apparatus showed satisfactory image formation having no defect such as toner dust image and toner spread at a character or small solid image and missing image area at the trailing end of such images, even with an increasing number of prints or life.

However, a reduced image density was observed in a solid image at the trailing end portion thereof as seen in a direction in which a sheet of paper is fed. This phenomenon may occur due to an insufficient amount of toner carried to and held by the developing roller 5 in developing a solid image and this is inherent in the development using non-magnetic toner with no polarity. Thus, a potential difference is provided between the developing roller 5 and the toner feed roller 6, as shown in FIG. 1, to improve the toner carriability, but it was found that the initial set value could not maintain the desired toner carriability with an increase in the life.

FIG. 6 shows a graph illustrating variations in the toner carriability with an increase in the number of prints, i.e., a graph illustrating variations in the toner carriability with an increase in the number of prints when −200 V was applied to the developing roller 5 and −300V to the toner feed roller 6, respectively. As seen from the graph, the toner carriability was about 95% immediately after the starting-up of the printer, but it was dropped to about 80% after making 10,000 prints. The drop of the toner carry quantity was due to accumulation of toner particles within the feeding roller 6 made of foamed elastomer, which in turn caused the feeding roller 6 to be hardened and contracted or reduced in its diameter and also to be formed with a skin-like film round the peripheral surface of the feeding roller 6.

FIG. 7 provides a table which compares the characteristics of the toner feed roller 6 at the initial start-up of the printer and at a time when 10,000 prints have been made. As appreciated from the characteristic table of FIG. 7, the diameter of the toner feed roller 6 was reduced with an increase of life of paper feeding (i.e., a number of prints from the first to the 10,000th prints), as a result of which the nip between the feeding roller 6 and the developing roller 5 was reduced and the roller-to-shaft resistances was increased, thereby decreasing the effect of bias voltage, and also the hardness was increased.

Toner carriability (Rb) in printing a solid image (which may also be referred to as solid image toner carriability hereinafter) is defined as follows:

$$Rb=De/Ds\times 100 \quad (1)$$

wherein, Ds represents the image density at the leading end portion of a solid image, and De the image density at the opposite trailing end portion of the solid image, respectively. It is noted that in recent years print of high-density graphic image is increasingly demanded. If the toner carriability is dropped below 85% as indicated in FIG. 6, however, the resulting image quality becomes poor by increased variation in the image density.

Now referring to the schematic diagram of FIG. 8, a method of measuring the toner carriability will be explained in the following. In FIG. 8, a suction attachment 71 having an opening area S of about 20 $cm^2$ is disposed in facing relation to the peripheral surface of the developing roller 5 which has formed thereon with a toner layer so that the toner layer is drawn by the nozzle 71 connected to a suction device 72. When the difference in weight of the developing apparatus before and after toner drawing is represented by Wd1, the opening area of the suction nozzle 71 by S, the amount of toner layer for a unit area under a normal state by m1, the toner charge quantity by Q1, and the electric charge quantity as measured by a micro-ammeter 73 when the toner particles separated from the developing roller S pass through a Faraday gage by Qt1, respectively, the toner layer amount m1 and the toner charge quantity Q1 can be expressed, respectively, as follows:

$$m1=Wd1/S(g/cm^2) \quad (2)$$

$$Q1=Qt1/Wd1(\mu c/g) \quad (3)$$

In order to evaluate the toner charge build-up characteristic and the toner carriability, the tests were made to measure charge quantity and quantity of toner drawn for a given unit area by continuous suction of the whole peripheral surface of the developing roller 5. These tests were performed with the apparatus shown in FIG. 5 by drawing the toner layer while rotating the developing roller 5 continuously for ten turns (which corresponds to A3 size sheet of paper). With the quantity of toner drawn by suction represented by Wd2 and the charge quantity by Qt2, respectively, the quantity of toner layer drawn for a given unit area by m2 and the toner charge quantity Q2 can be expressed, respectively, as follows:

$$m2=Wd2/(S\times 10)\ (g/cm^2) \quad (4)$$

$$Q2=Qt2/Wd2(\mu c/g) \quad (5)$$

It was expected that changing the voltage for application to the toner feed roller 6 with an increase in the number of prints would be effective to solve the problem of toner carriability drop and, therefore, testing was conducted to find appropriate toner feed bias voltages at different numbers of prints. FIG. 9 is a graph showing variations in the toner carriability with an increase in the number of prints when the voltage applied to the toner feed roller 6 was changed with a life. As shown in FIG. 9, it can be confirmed that the solid image toner carriability above 85% could be successfully maintained by changing voltage applied to the toner feed roller 6 from the initial magnitude of −300 V to the maximum of −500 V.

Reference is now made to FIG. 10 providing a graph and a table showing the improvement tendency in reducing fogging on the photosensitive drum 4 and in the charge quantity thereof. More specifically, FIG. 10*a* shows the improvement in fogging reduction and FIG. 10*b* depicts the improvement in the charge quantity after making a predetermined number of prints, respectively. As seen from FIG. 10*a*, fogging produced on the photosensitive drum 4 (i.e. B.G on drum indicated on the ordinate) when a toner feed bias voltage of −500 V was applied was more than two times as much as when a bias voltage of −300 V was applied. It can be assumed that this increased fogging was due to reduction by half of the toner charge quantity (Q2), that is a decrease from 8.45 $\mu$C/g accomplished with the bias voltage −300 V to 4.29 $\mu$C/g with −500 V, as shown in FIG. 10*b*, and also that the chargeability of toner carried electrically to the developing roller 5 was reduced, accordingly.

In other words, the greater the absolute value of bias voltage applied to the toner feed roller 6 provided for supplying toner to the developing roller 5, the greater quantity of toner is fed to the developing roller 5, so that a greater quantity of toner is brought into contact with the blade 8. Thus, the capability of imparting charge to the toner is reduced, with the result that the fogging (B.G) was increased. This phenomenon is inherent in a monocomponent nonmagnetic development.

Since the fogging present on the photosensitive drum 4 is collected by the photosensitive drum cleaner 56 and treated as waste, it is desirable that fogging should be kept as little as possible. Here it becomes necessary to take some effective measures to reduce the fogging, that is, to improve the toner chargeability. It is effective for an increase in toner chargeability to increase a pressure with which the blade 8 shown in FIG. 1 is pressed against the developing roller 5, but only at the sacrifice of more torque required to drive the developing drum 5 and undesirable crushing of toner particles. As a results, the increase of the above pressure of the blade 8 with an attempt to improve the toner chargeability may cause an increase of fine toner particles and hence production of problematic dust images.

Figure 11:
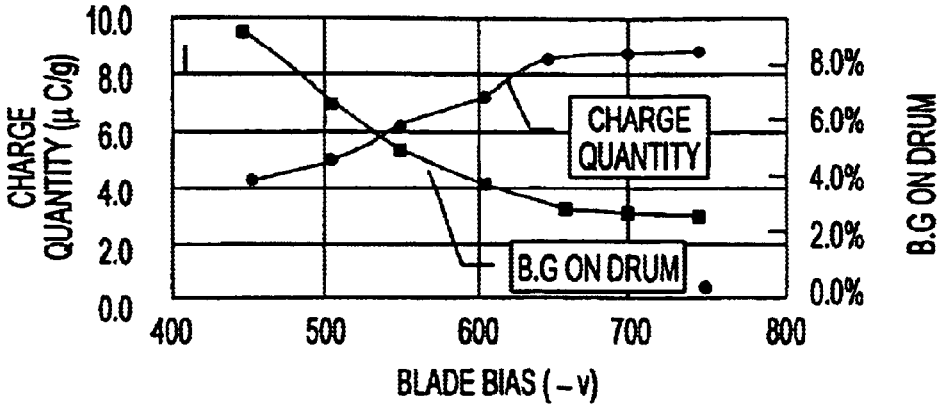
FIG. 11 is a graph showing characteristic variations in the toner charge quantity and the fogging on the photosensitive drum, respectively, with the blade bias voltage as a function.

Then, further testing was made to ascertain how the toner chargeability and the fogging on the photosensitive drum 4 vary when the blade bias voltage was changed. The testing results are provided in FIG. 11, which reveals that the charge quantity Q2 could be improved and the fogging on the photosensitive drum 4 (or B.G on drum) reduced by stepping up the bias voltage for application to the blade 8 with an increase in the bias voltage to the toner feed roller 6.

The following will now describe a method of controllably changing the bias voltage for application to the blade 8. As discussed in the above, decrease of the toner chargeability depends on the blade bias voltage applied to the toner feed roller 6. In other words, since the decrease of toner chargeability is dependent on the increment of electrical toner carry quantity, two methods can be contemplated for controllably changing the blade bias voltage.

According to the first method, the actual current voltage being applied to the toner feed roller 6 is detected by monitoring the electrical resistance thereof which represents the physical characteristic of the toner feed roller 6, and the voltage for application to the blade 8 is changed depending on the value of the detected toner feed bias voltage. It is noted that the change in physical characteristic of the toner feed roller 6 occurs in a proportional relation to an increase in the number of prints. In the second method, therefore, the running distance (or number of rotations) of the photosensitive drum 4 is counted to determined the actual current voltage being applied to the toner feed roller 6, and the voltage to be applied to the blade 8 is determined in dependence on the value of the accumulated running distance of the photosensitive drum 4. These two methods will be described more in detail below.

Figure 12:
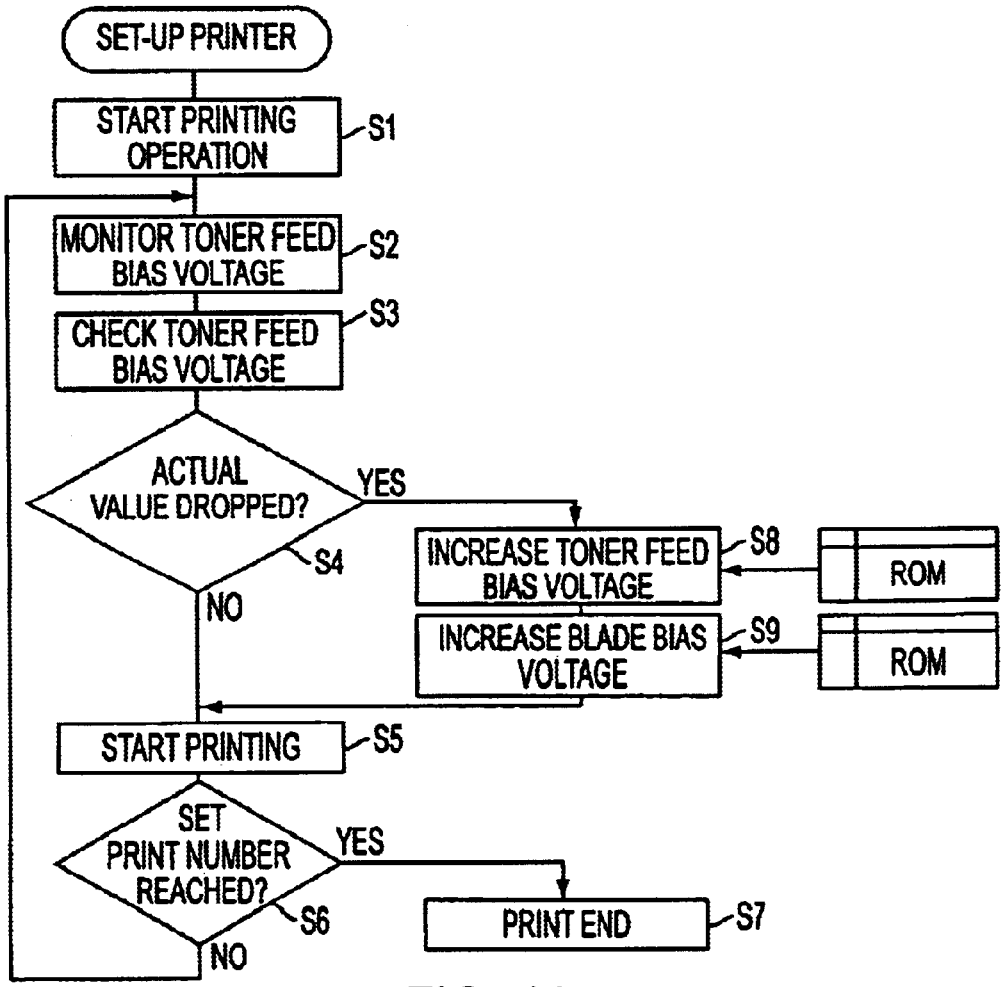
FIG. 12 is a flow chart illustrating a first controlling method of changing over the blade bias voltage.

FIG. 12 is a flow chart illustrating the first method of controllably changing the voltage for application to the blade. With this control method, after the printer has been set up and subsequently started for printing operation at Step 1 ("Step" will be abbreviated as "S" hereinafter), simultaneously monitoring of the current bias voltage to the toner feed roller 6 is initiated (S2) to check the voltage (S3) by any suitable measuring instrument connected to the toner feed roller 6 so as to determine whether or not the actual current bias voltage to the feeding roller 6 is dropped (S4). If no drop is recognized (NO at S4), printing is started (S5) as it is. Steps 2 though 6 are repeated if a predetermined number of prints has not yet been completed (NO at S6). When the predetermined number of prints has been made (YES at S6), the step proceeds to print end (S7). If a drop in the current actual bias voltage is detected at S4 (YES at S4), CPU and ROM operate to figure out a toner feed bias voltage which is required to compensate for the drop, and the toner feed bias voltage is stepped up (S8), accordingly. Furthermore, CPU and ROM operates to calculate a bias voltage for application to the blade 8 in accordance with the stepped-up amount of the toner feed bias voltage, and the blade bias voltage is stepped up (S9), accordingly. This step (S9) is followed by start of printing (S5).

Figure 13:
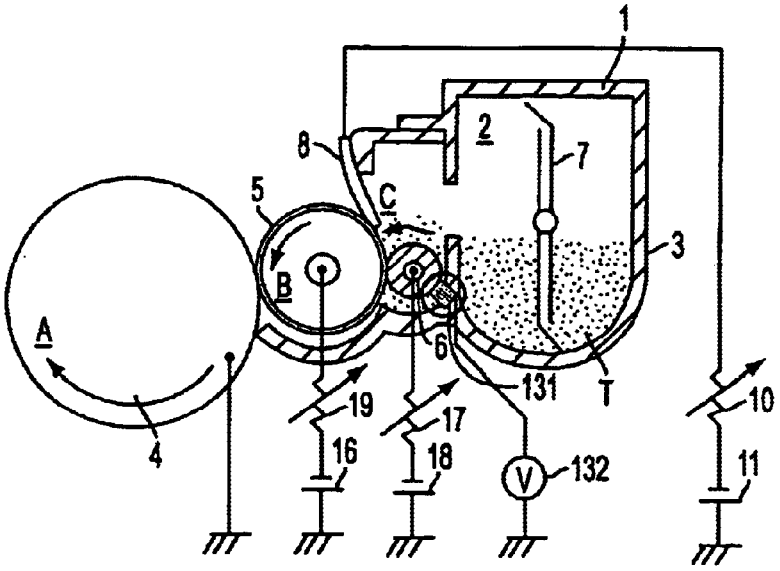
FIG. 13 is a schematic representation showing an arrangement for monitoring the toner feed bias voltage in the developing apparatus.

FIG. 13 is a schematic diagram similar to FIG. 1, but showing an arrangement which additionally includes a toner feed bias voltage monitoring device and also the manner in which the toner feed bias voltage is monitored in the developing apparatus. As shown in FIG. 13, a contact member 131 having an extremely low electrical resistance is disposed in constant contact with the surface of the toner feed roller 6. The contact member 131 may include a conductive brush or a thin metal sheet which is designed not to cause damage to the surface of the toner feed roller 6. Voltage monitoring is accomplished by measuring the voltage across the contact member 131 by a voltmeter 132.

Figure 14:
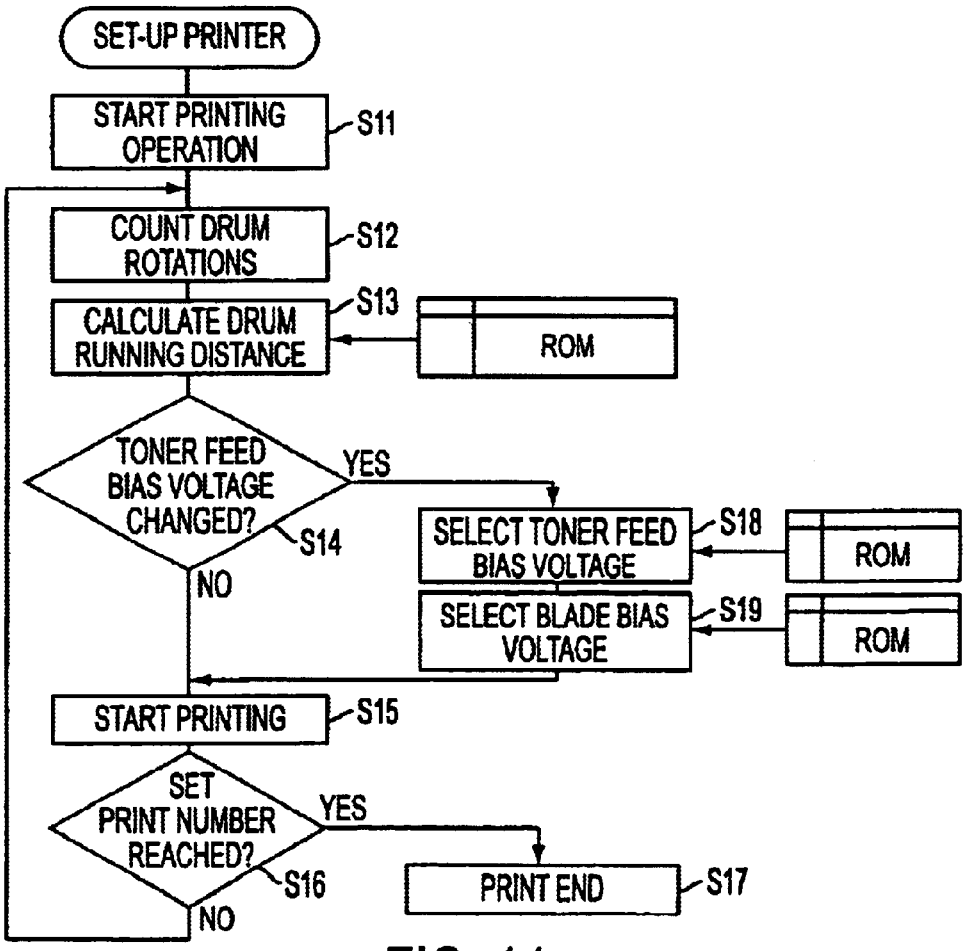
FIG. 14 is a flow chart showing a second controlling method of changing over the blade bias voltage.

FIG. 14 is a flow chart showing the second control method of controllably changing the bias voltage for application to the blade. According to this second method, after the printer has been set up and the printing operation is started (S11), counting the number of rotations of the photosensitive drum 4 by an (rotary) encoder mounted to a motor for driving the photosensitive drum 4 is initiated (S12). Thus, the running distance of the photosensitive drum 4 is calculated by CPU and ROM (S13) from the measurements by the encoder.

Then, it is determined, on the basis of the result of calculated running distance, whether or not the current toner feed bias voltage should be changed (S14). If it is determined that the change is not necessary (NO at S14), printing is started as it is (S15) and the above Steps are repeated until a predetermined number of prints is completed (NO at S16). When the predetermined number of prints has been completed (YES at S16), the step proceeds to print end (S17).

If it is determined that the toner bias voltage change is necessary (YES at S14), an appropriate magnitude of toner feed bias voltage is selected by CPU and ROM (Sl8) and then a bias voltage for application to the blade 8 is selected by ROM (S19) in accordance with the selected toner feed bias voltage. Printing is started (S15) with the selected bias voltage applied to the blade 8. As understood from comparison between the first and second controlling methods represented in FIGS. 12 and 14, the second method is advantageous over the first method in terms of cost because the former method can dispense with measuring instruments including the contact member 131, the voltmeter 132 and other related devices that are used in the first method.

Print testing was conducted by printing as many as 20,000 sheets of paper using a printer, which is controlled according the above-described methods. Data obtained from the testing of 20,000 sheets of paper with the voltage applied to the blade being controlled are provided in FIG. 15. As is apparent from the testing data, the image forming apparatus whose operation was controlled by the method of the embodiment could successfully maintain the solid image toner carriability at least at 95% and the toner charge quantity at least around 8.5 $\mu$C/g and suppress fogging phenomenon (or B.G on the photosensitive drum) to about 3%, thus producing consistent print image quality. The image forming apparatus operable according to such methods of controllably changing the blade bias voltage is often applied to medium-speed digital PPCs or printers, which are designed to operate at 12 to 25 ppm.

Then referring to FIG. 16, another embodiment of developing apparatus using a mono-component nonmagnetic developer and constructed according to the present invention will be described in the following. As appreciated from comparison thereof with the first preferred embodiment shown in FIG. 1, the embodiment of FIG. 16 differs from the first embodiment in that bias voltages to the developing roller 5 and to the toner feed roller 6 are supplied from a common bias voltage source 161, so that the same potential is applied to the developing roller 5 and the toner feed roller 6. Since the parts, elements or arrangement other than the common bias source 161 of the embodiment of FIG. 16 are substantially the same, as the counterparts of FIG. 1, detailed description of such matters will be omitted.

Figure 16:
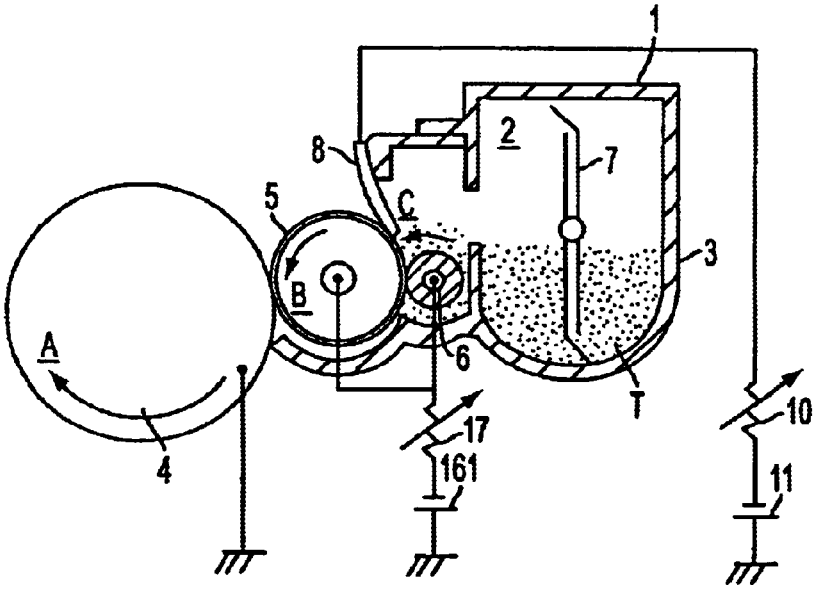
FIG. 16 is a schematic diagram showing another embodiment of mono-component nonmagnetic type developer of the image forming apparatus according to the present invention.

In view of the testing results that the toner carriability is influenced by the physical characteristics of the toner feed roller 6 as discussed earlier with reference to the first embodiment of FIG. 1, the cell density of the toner feed roller 6 and the width of a nip thereof with the developing roller 5 were increased in the embodiment of FIG. 16 to improve the toner carriability. That is, the toner feed roller 6 of the present embodiment was so constructed that the cell density of its electrically conductive urethane foam 32 was increased to 120 to 150 per square inch and also that the outer diameter of the roll 6 was increased to about 13.5 mm thereby to widen the nip of the toner feed roller 6 with developing roller 5 by about 0.5 mm.

The developing apparatus thus constructed according to the present embodiment of FIG. 16 was incorporated in a laser printer, and testing thereof was conducted. For the testing, the process speed was set at about 32 mm/second, a negative charging type OPC with about 30 mm diameter was used as the photosensitive drum 4, and the developing roller 5 was driven to rotate at about 48 mm/second of peripheral speed (i.e., at a speed of about 1.5 times as high as that of the photosensitive drum). The surface potential of the photosensitive drum 4 was set at −540 V, the bias voltages for application to the toner feed roller 6 and to the developing roller 5 at −200 V, and the bias voltage for application to the blade 8 at −400 V, respectively. Since the manner of operation of the laser printer is substantially the same as that which has been already explained with reference to the first embodiment, detailed description about the operation of the printer in which the developing apparatus is incorporated will be omitted.

Results from print testing conducted with the above-described image forming apparatus showed satisfactory image formation having no defect such as toner dust image and toner spread at a character or small solid image and missing image area at the trailing end of such images, even with an increasing number of prints. Further, reduced image density was not observed in a solid image at the trailing end portion thereof.

Referring to the graph of FIG. 17 which shows variation in the toner carriability with an increase in the number of prints in the embodiment of developing apparatus of FIG. 16, the toner carriability measured about 92% during printing operation immediately after the initial start-up of the printer and it was about 86% after 10,000 prints have been completed. Thus, it was ascertained that no problem occurred with the toner carriability in the embodiment of FIG. 16. Incidentally, the toner carriability was measured by using the same method as described above.

It was also recognized from the testing results that there occurred no remarkable problem with the fogging on the photosensitive drum 4. After printing about 6,000 sheets when the toner carriability was decreased below 90% and the toner layer thickness on the developing roller 5 became about 0.6 mg/cm$^2$, however, white lines appeared in a solid image. Investigating a cause of such defect revealed that the formation of while lines was due to leakage caused by difference between voltages applied to the developing roller 5 and to the blade 8 which occurred with a decrease of the toner carriability. Accordingly, further testing was made to ascertain under what blade bias voltages the leakage could be prevented when the toner layer thickness on the developing roller 5 was 0.6 mg/cm$^2$ or less.

The testing results are provided in the table of FIG. 18 which shows various blade bias voltages in connection with the presence/absence of leakage in the developing apparatus of FIG. 16. As is clear from the table, it was ascertained that leakage could be prevented by application of a blade bias voltage of −350 V or less (or such a voltage that the difference between the blade and developing roller bias voltages is within 150 V) when the toner layer thickness on the developing roller 5 was 0.6 mg/cm$^2$ or less.

Referring to FIG. 19 showing the charge quantities varying with a blade bias voltage in the developing apparatus of FIG. 16, it was found that sufficient toner charge quantity could be achieved with application of a bias voltage smaller than a leakage threshold value of −350 V.

Figure 20:
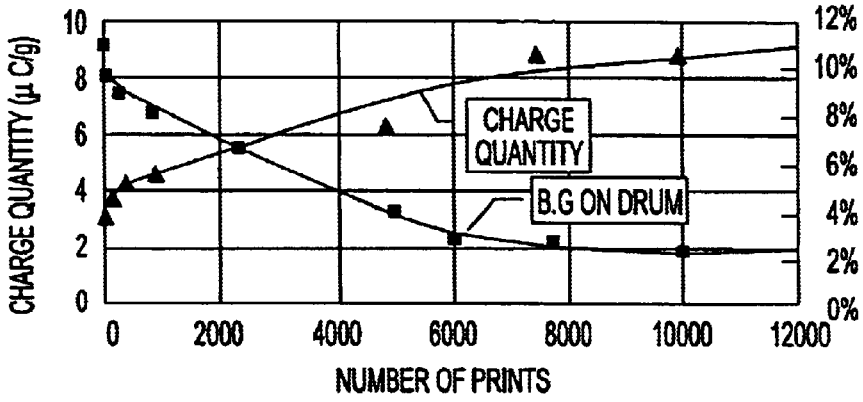
FIG. 20 is a graph showing variations in the toner charge quantity and the fogging on the photosensitive drum, respectively, with the blade bias voltage as a function, in the development apparatus according to the embodiment of FIG. 16.

FIG. 20 provides a graph showing variations in the toner charge quantity and the fogging on the photosensitive drum, respectively, with the increasing number of prints as a function in the case of the developing apparatus of FIG. 16. That is, the present inventors considered −300 V as an appropriate level of blade bias voltage after making 10,000 prints and, therefore, the graph of FIG. 20 shows the variation in the toner charge quantity and the fogging when −300 V of blade bias voltage was applied from the start-up of the apparatus of FIG. 16. As seen in FIG. 20, the toner charge quantity was low and fogging slightly smaller than 10% appeared on the drum at the time of start-up of the developing apparatus, and the fogging on the drum resulted in formation of fogging on the background of image on the image recording medium. With an increasing number of prints, however, there showed a tendency for the toner quantity to increase and for the fogging to decrease. Thus, it was ascertained that blade bias voltage should be changed as required for improving the image quality.

The following will deal with methods of controllably changing the bias voltage for application to the blade 8 in the developing apparatus shown in FIG. 16. In view of the fact that the toner chargeability drop depends on the change of physical characteristics of the blade 8 as discussed earlier herein, two control methods will be explained in the following. According to the first control method, change of the physical characteristic of the toner feed roller 6 is monitored by detecting the electrical resistance and the blade bias voltage application is controlled according to the detected value of such resistance. In the second control method which is contemplated in view of the fact that change of the physical characteristic of the toner feed roller 6 occurs in a proportional relation to an increase in the number of prints, the running distance of the photosensitive drum 4 is measured or counted and the bias voltage to be applied to the blade 8 is changed in dependence on the value of accumulated running distance of the photosensitive drum 4. These two controlling methods will be described more in detail in the following.

Figure 21:
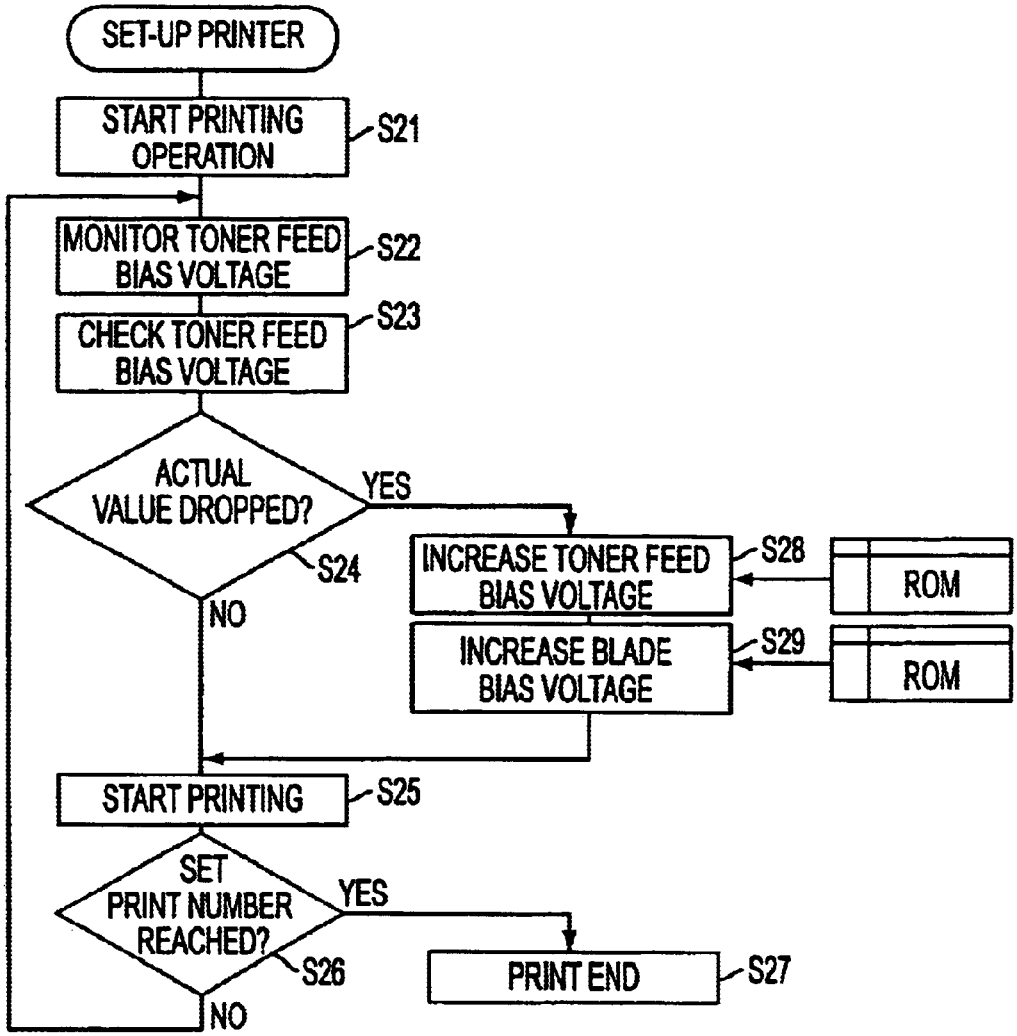
FIG. 21 is a flow chart illustrating a first controlling method of changing the blade bias voltage in the development apparatus according to the embodiment of FIG. 16.

Reference is made firstly to the flow chart of FIG. 21, which illustrates the first controlling method. After the printer has been set up and subsequently started for printing operation (S21), simultaneously monitoring of the current bias voltage to the toner feed roller 6 is initiated (S22) to check the voltage (S23) by any suitable measuring instrument (such as contact member 131 and voltmeter 132 shown in FIG. 13) so as to determine whether or not the actual current bias voltage to the feeding roller 6 is dropped (S24). If no drop is recognized (NO at S24), printing is started (S25) as it is. Steps 22 though 26 are repeated if a predetermined number of prints has not yet been completed (NO at S6). When the predetermined number of prints has been made (YES at S26), the step proceeds to print end (S27).

If the current bias voltage is found dropped at S24 (YES at S24), on the other hand, CPU operates to measure the degree of voltage drop and figure out a toner feed bias voltage (S28) which is appropriate to compensate for the drop on the basis of data stored in ROM. Accordingly, the blade bias voltage is stepped down (S29) in correspondence with the rate of dorp of the toner carriability, which is followed by a start of printing (S25).

Monitoring of the toner feeding bias voltage in this first control method of FIG. 21 may be accomplished by using the contact member 131 shown in FIG. 13 which includes a conductive brush or a thin metal sheet having an extremely low electrical resistance and disposed constantly in contact with the surface of the toner feed roller 6 without causing any damage to the surface of the roller 6.

Figure 22:
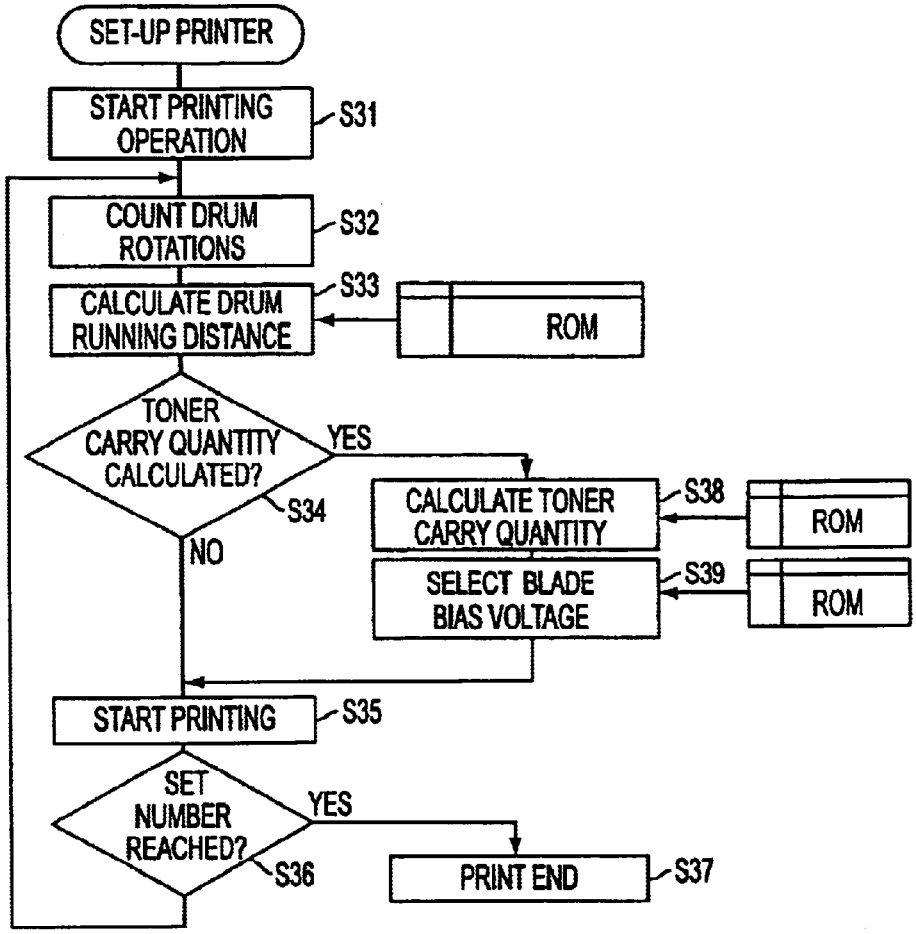
FIG. 22 is a flow chart illustrating a second controlling method of changing the blade bias voltage in the development apparatus according to the embodiment of FIG. 16.

FIG. 22 is a flow chart showing the second method of controllably changing the bias voltage for application to the blade 8. According to this second method, after the printer has been set up, printing operation is started (S31) and, simultaneously, the number of rotations of the photosensitive drum 4 is counted (S32) by any suitable means such as an encoder mounted to a motor for driving the photosensitive drum 4. The running distance of the photosensitive drum 4 is calculated by CPU and ROM (S33) from the measurement determined.

Then, it is determined whether or not the toner carry quantity must be calculated with reference to the running distance of the photosensitive drum 4 (S34). If it is determined that the calculation is not necessary (NO at S34), printing is started as it is (S35) and Steps 32 through 36 are repeated if a predetermined number of prints is yet to be printed (NO at S36). When the predetermined number of prints has been completed (YES at S36), the step proceeds to print end (S37).

If it is determined that the toner carry quantity must be calculated (YES at S34), on the other hand, a toner carry quantity corresponding to the running distance of the photosensitive drum 4 is selected by CPU and ROM (S38) and then a blade bias voltage is selected by ROM in accordance with the selected toner transfer quantity by ROM (S39). Printing is started (S35) with the selected bias voltage applied to the blade 8.

As is apparent from comparison between the above two methods described with reference to FIGS. 21 and 22, the second method is advantageous over the first counterpart in terms of cost because the second method can dispense with measuring instruments including the contact member 131, the voltmeter 132 and other related devices used in the first method.

Print testing was conducted with the printer equipped with the developing apparatus of FIG. 16 by printing 10,000 sheets of paper according to the above-described methods of controllably changing the blade bias voltage. As seen from the testing results shown in FIG. 23, the image forming apparatus could successfully maintain the solid image toner carriability at least at 86% and the toner charge quantity at least around 8.6 $\mu$C/g and suppress fogging phenomenon (or B.G on the photosensitive drum) to about 3%, thus producing consistent print image quality. Thus, it could be ascertained in the testing that satisfactory image quality could be achieved with little drop in the toner charge quantity and little increase of fogging while avoiding leakage. The image forming apparatus operable according to such methods of controlling the blade bias voltage is often applied to low-speed digital PPCs or printers, which are designed to operate at 6 to 10 ppm.

A problem with a developing apparatus using mono-component nonmagnetic toner has been known in the art that the toner chargeability tends to be decreased when the apparatus is left unused for a long period of time, and the chargeability tends to be aggravated by moisture absorption by the toner when the apparatus is placed under a high-temperature and high-humidity environment. An attempt has been made heretofore, therefore, to lessen the drop of toner chargeability by mixing or stirring moistened toner particles with relatively less moistened particles when power for a digital PPC or printer is turned on after it has been left in off state.

There is a tendency in recent years that a PPC, a facsimile machine and a printer are integrated into a single composite machine (or MFP: Multi Function Periphery) and such composite equipment is becoming increasingly popular. Because such composite machine is often left in on or energized state, toner mixing by turning on the power is seldom performed, with the result that fogging on the photosensitive drum and dust image on the printed image tends to be increased and reproducibility of characters and fine lines becomes poor. Thus, an improvement of the apparatus to prevent such print defects is needed.

As is apparent from the foregoing description about the embodiments of image forming apparatus of the present invention, it was ascertained that controllably changing the bias voltage for application to the blade 8 was effective for improvement of toner chargeability. Noting that a fixing device of an image forming apparatus of the type disclosed herein has a sleep mode setting, the inventors contemplated providing means for stepping up the blade bias voltage to a predetermined level after a release of the sleep mode of the fixing device and keeping such voltage until a predetermined number of prints has been made. The following will describe in detail such means for stepping up the blade bias voltage. It is noted that a printer used for testing was of the type shown in FIG. 1 that the bias voltages for application to the developing roller 5 and to the toner feed roller are supplied from independent voltage sources.

FIG. 24 provides graphs which show testing results representing the development of fogging on the photosensitive drum with a function of the discharge time. FIGS. 24*a* and 24*b* show the characteristic graphs under an ordinary room temperature and under an environment of 30° C. and RH 85%, respectively. As seen from the graphs, when the printer is left unused for more than five hours (or 300 minutes), the first print had poor image quality due to fogging on the photosensitive drum, but the fogging decreased as the printing proceeded and consistent image quality could be achieved at about the 10th print and thereafter. This means that (a) moistened toner particles are supplied to the photosensitive drum as fogging toner during early stage of printing operation, and (b) toner chargeability became improved by the effect of toner mixing done in such a way that moistened toner particles and less moistened particles are mixed, with the result that prints after about the 10th had consistent satisfactory image quality. Then, the present inventors contemplated controlling the printer operation in such a way that the bias voltage for application to the blade 8 is stepped up for the first ten consecutive prints when the apparatus is left unused for two hours or more as counted from the moment when the fixing device is placed under a sleep mode. The above number of ten prints is merely an example and, therefore, the number of prints may be changes as required.

The following will deal with the magnitude of bias voltage, which would be necessary to reduce the fogging on the photosensitive drum to a predetermined target value of percentage. Since fogging on the photosensitive drum will become a waste as mentioned earlier, fogging should be kept as little as possible. In view of the function performed by fogging toner as a lubricant at the slide between the cleaning blade and the photosensitive drum, however, it could be considered that the fogging should be limited to about 3.0% under an ordinary room temperature and to about 5.0% under an environment of high temperature and humidity, respectively.

Further testing was carried out to find an optimum blade bias voltage for reducing the fogging to the desired levels. FIG. 25 provides the testing results showing the relation between fogging and the blade bias voltage, wherein the table of FIG. 25*a* shows the results when 500 prints were made, and FIG. 25*b* when 15,000 prints were made, respectively. As appreciated from the tables, when printing operation is resumed after the printer is left unused for any period of time, stepping up the blade bias voltage by 30 to 100 V could be effective to limit the fogging to 3.6% or less under an ordinary room temperature and less than 5.0% under high temperature and humidity.

Figure 26:
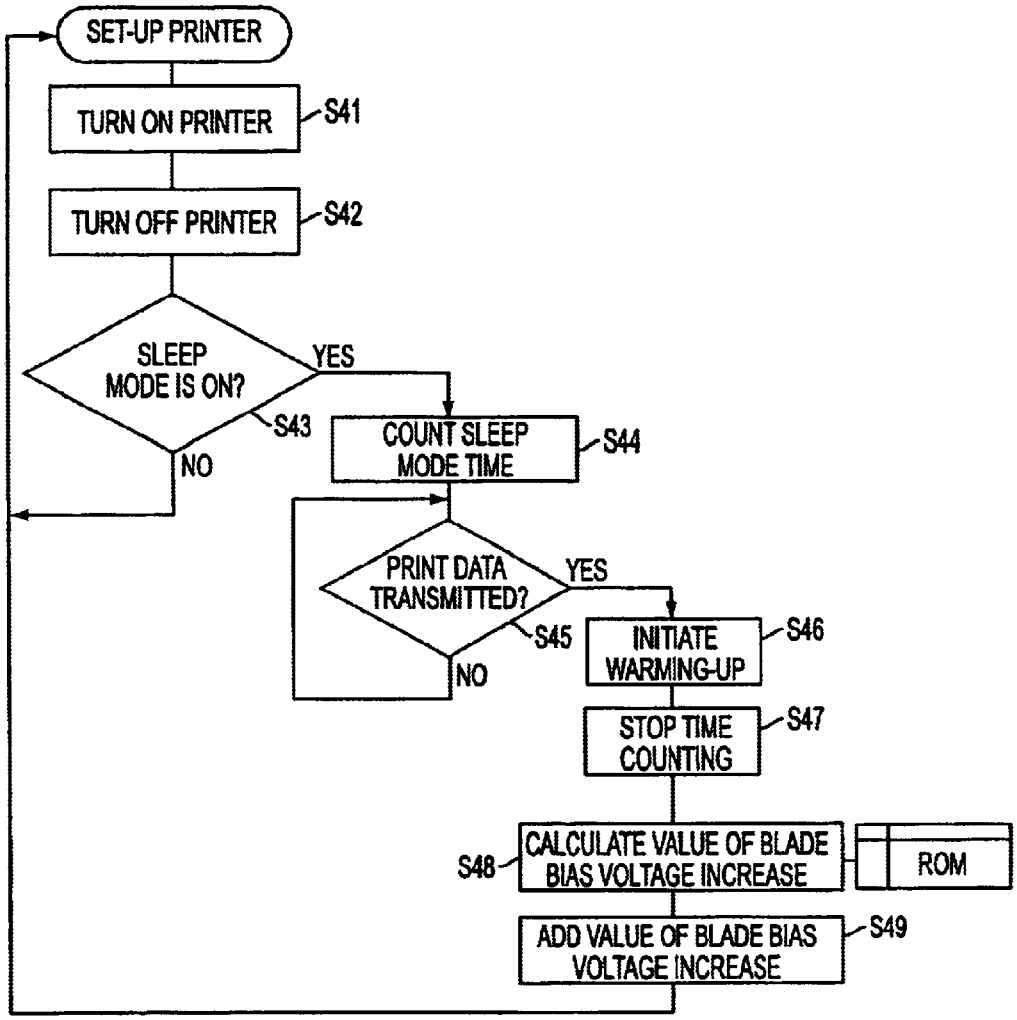
FIG. 26 is a flow chart showing a controlling method of stepping up the blade bias voltage.

For stepping up the bias voltage to the blade in the illustrated embodiment, a control method as illustrated in the flow chart of FIG. 26 is employed. In operation, when the printer is turned off (S42) from an on state thereof (S41), it is determined whether or not the fixing device of the printer is placed into its sleeve mode (S43). If it is determined that the fixing device is in sleep mode (YES at S43), a counter incorporated in the printer starts to count the length of time during which the fixing device is left in its sleep mode (S44) and such counting is continued until the next printing operation is resumed.

At the next step (S45), is determined whether or not print data is transmitted to the printer. If transmitted (or YES at S45), the fixing device starts its warming-up operation (S46) and, simultaneously, time counting operation is stopped (S47). Then, CPU and ROM operate to figure out the extent of blade bias voltage increase corresponding to the length of time determined by the counter (S48). Information of calculated increment of bias voltage is transmitted to blade bias voltage application means, which in turn operates to step up the blade bias voltage by adding the calculated increment (S49).

It is noted that this control method of stepping up the blade bias voltage is also applicable to a printer of the type in which voltage of the same magnitude is applied to both the developing roller 5 and the toner feed roller, as represented by the image forming apparatus shown in FIG. 16. In the case of such printer, the extent of stepping up of the voltage determined from the counted time may be lessened because the chargeability of toner carried to the developing roller 5 is slightly better than the printer described with reference to FIG. 26. In short, it is necessary that such a blade bias voltage should be applied that can stabilize the toner chargeability between the blade and the developing roller 5.

In a developing apparatus using mono-component non-magnetic toner, a difference in toner charge quantities takes place between the first turn of the developing roller 5 immediately after a start-up of the printer and the second and the following turns (which will be referred to as "second turn et seq." hereinafter) thereof even if a bias voltage was applied to the toner layer forming blade with an attempt to increase the toner chargeability. Such difference in the charge quantity results in a difference in the image density, and the phenomenon of image density difference appears more remarkably in graphic images.

Figures 27, 28:
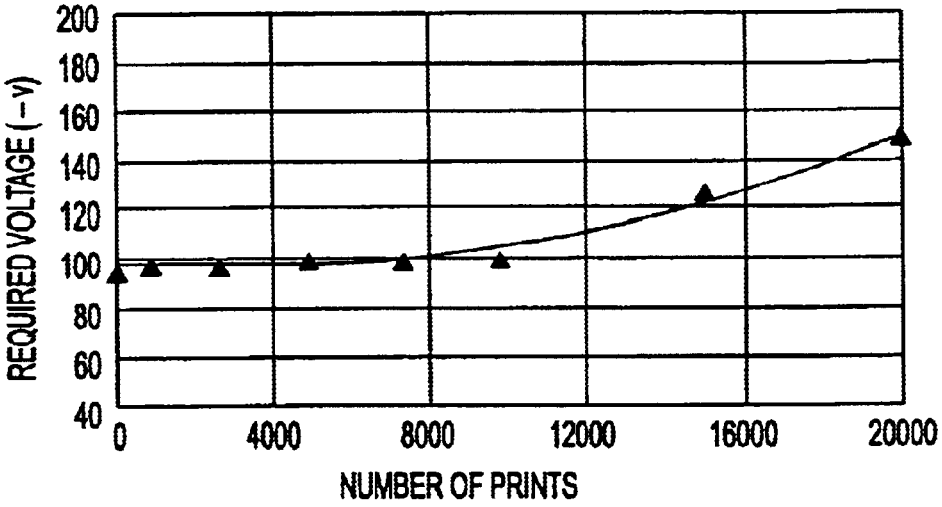
FIG. 27 is a table which compares the toner charge quantities obtained in the first turn and in the second and the following turns of the developing roller in a printer having incorporated therein the developing apparatus of the present embodiment, as well as the image densities corresponding to the respective toner charge quantities.
FIG. 28 is a graph showing the magnitudes of voltage to be stepped down in the first turn of the developing roller for making the toner charge quantities substantially the same in the first turn and in the second and the following turns of the developing roller in making 20,000 prints.

Referring to FIG. 27 providing a table comparing toner charge quantities and the corresponding image density between the images produced after the first turn of the developing roller 5 used in the printer according to the illustrated embodiment and the second turn et seq. thereof. Toner charge quantity was measured by using the method described in earlier part hereof. As seen from the table, difference in toner charge quantity was observed between the images produced by the first turn of the developing roller 5 and the second turn et seq. thereof and the difference was increased to about 4.6 $\mu$C/g at the 20,000th print. With regard to the image density, the difference was only 0.04 $\mu$C/g during printing at an early time, while it was increased to about 0.08 $\mu$C/g when 20,000 prints have been made.

Observing the produced graphic images, it became clear that an image produced by the first complete turn of the developing roller 5, which corresponds to a distance of about 37.7 mm, showed a lower density, while the density of images produced thereafter was increased. In recent years, there has been an increasing demand of printing graphic images and, therefore, a printer that is capable of producing high quality graphic images is demanded. Thus, a solution to the aforementioned problem is called for.

In view of above, the development apparatus according to the present embodiment is designed to solve the aforementioned problem on the basis of the following. That is, with the development apparatus according to the present embodiment, enhancement of toner chargeability could be accomplished by controllably changing the bias voltage for application to the toner layer-forming blade. By using this blade bias controllable mechanism, means is provided for regulating the toner charge quantities substantially the same in the first turn and the second turn et seq. of the developing roller.

For regulating the toner charge quantities substantially the same in the first turn and the second turn et seq. of the developing roller, there are two methods as will be described in the following. According to the first method, the blade bias voltage is stepped down during the period of time corresponding to the first turn of the developing roller to reduce the toner charge quantity. In the second method, the blade bias voltage is stepped up in the second turn et seq. of the developing roller thereby to increase the toner charge quantity. Testing were conducted under various conditions to find a target value of difference in the charge quantities between the first turn and the second turn et seq. of the developing roller. It was confirmed from the testing results that an image density difference of 0.02% or less would not be noticeable and, therefore, it was so arranged that a difference of toner charge quantity should be limited to 1.0 $\mu$C/g or less with respect to a reference value of toner charge quantity. The following will explain the first and second methods of controllably changing the blade bias voltage so as to make the toner charge quantities substantially the same between the first turn and the second turn et seq. of the developing roller.

Firstly, the first method for regulating the toner charge quantities substantially the same between the first turn and the second turn et seq. of the developing roller will be described in detail below. FIG. 28 is a graph plotting the magnitudes of voltage to be reduced in the first turn of the developing roller 5 in printing 20,000 sheets of paper for making the toner charge quantities substantially the same in the first turn and the second turn et seq. of the developing roller 5. As seen from FIG. 28, a drop of about 100 V is necessary in the first turn of the developing roller 5 with respect to the voltage in the second turn et seq. during the early period of time. With an increase in the number of prints, however, the voltage difference should be also increased and a difference of about 150 V becomes necessary when 20,000 prints have been made.

In view of above, a bias voltage for application to the toner layer forming blade for a period of time corresponding to the first turn of the developing roller is controllably reduced form a standard voltage by 100 V to 150 V depending on the number of prints then made. Since the extent of voltage reduction depends on the number of prints made, the running distance of the photosensitive drum 4, which represents the number of prints made, is counted, and the necessary voltage reduction is effected when the accumulated running distance of the photosensitive drum has reached a predetermined value.

Figure 29:
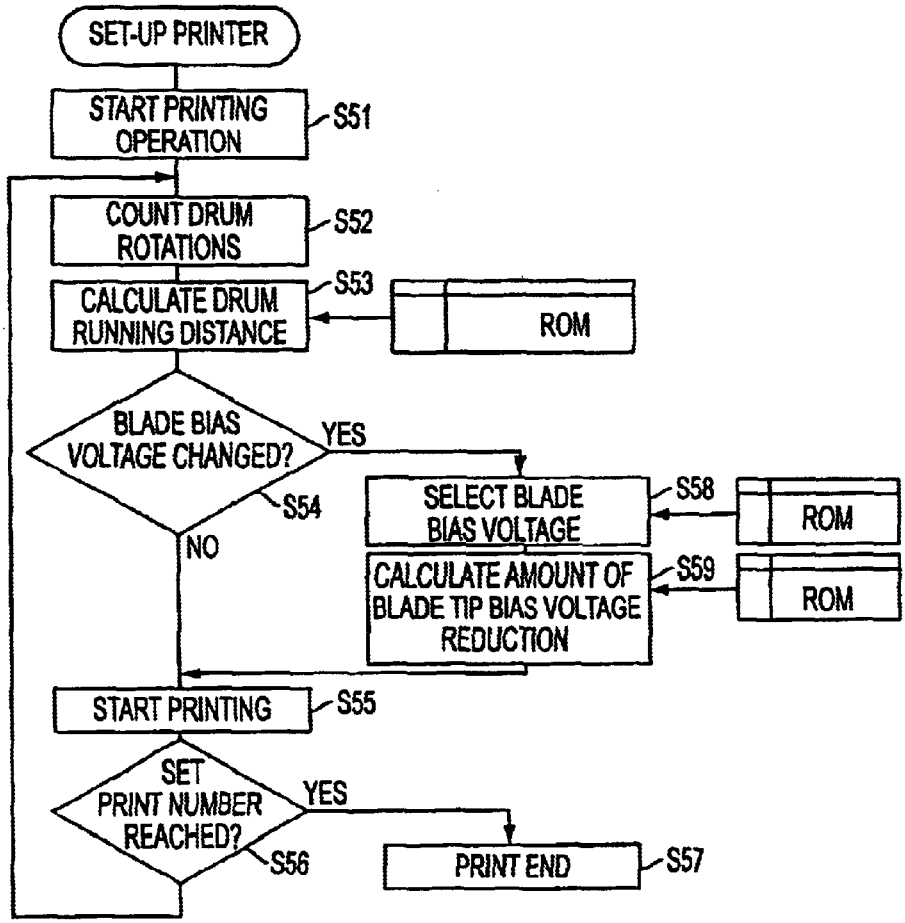
FIG. 29 is a flow chart illustrating a method of controllably stepping down the blade bias voltage from a predetermined value.

FIG. 29 is a flow chart illustrating the method of controllably changing or reducing the blade bias voltage from a reference value. According to this method, the printer is started (S51) for printing operation after the printer set-up is over and, simultaneously, the number of rotations of the photosensitive drum 4 is counted (S52) by an encoder mounted to a motor for driving the photosensitive drum 4. According to the measurements, the running distance of the photosensitive drum 4 is calculated by CPU and ROM (S53).

Then, it is determined whether or not the blade bias voltage must be changed with reference to the calculated running distance (S54). If it is determined that the changing is not necessary (NO at S54), printing is started as it is (S55) and Steps 52 through 56 are repeated if a predetermined number of prints is yet to be printed (NO at S56). When the predetermined number of prints has been completed (YES at S56), the step proceeds to print end (S57).

If it is determined that the blade bias voltage must be changed (YES at S54), on the other hand, a reduced blade bias voltage for application to the blade in the first turn of the developing roller 5 is selected by CPU and ROM (S58) according to the measurement of the running distance and then a magnitude of reduction of blade bias voltage is selected by ROM in accordance with the above selected reduced blade bias voltage (S59). That is, a bias voltage corresponding to a value found by subtracting the value for the magnitude of reduction from standard value of blade bias voltage is applied to the toner layer forming blade during the period of printing corresponding to the first turn of the developing roller 5 as counted from the start of printing operation (S55). During further printing from the second turn et seq. of the developing roller 5, the bias voltage of standard value is applied until print end (S57) is reached.

The following will explain the method of detecting the print start timing. According to the above-described bias voltage changing method, the bias voltage for application to the blade must be changed when the toner is transferred to the photosensitive drum 4 during the developing process in the first turn of the developing roller 5. For example, if print data are present mainly at the center portion of a sheet of paper to be printed and the first turn of the developing roller 5 as starting from the leading end of the sheet does not cover the print data area on the sheet, no toner would be transferred form the developing roller, except fogging toner, to the photosensitive drum 4. In such a case, blade bias voltage changing would have been already completed when print data area is reached and toner begins to be transferred to the photosensitive roller 4 and, therefore, undesirable difference in image density would occur between print data area corresponding to the first turn of the developing roller 5 and that to the second turn et seq. thereof.

Figure 30A:
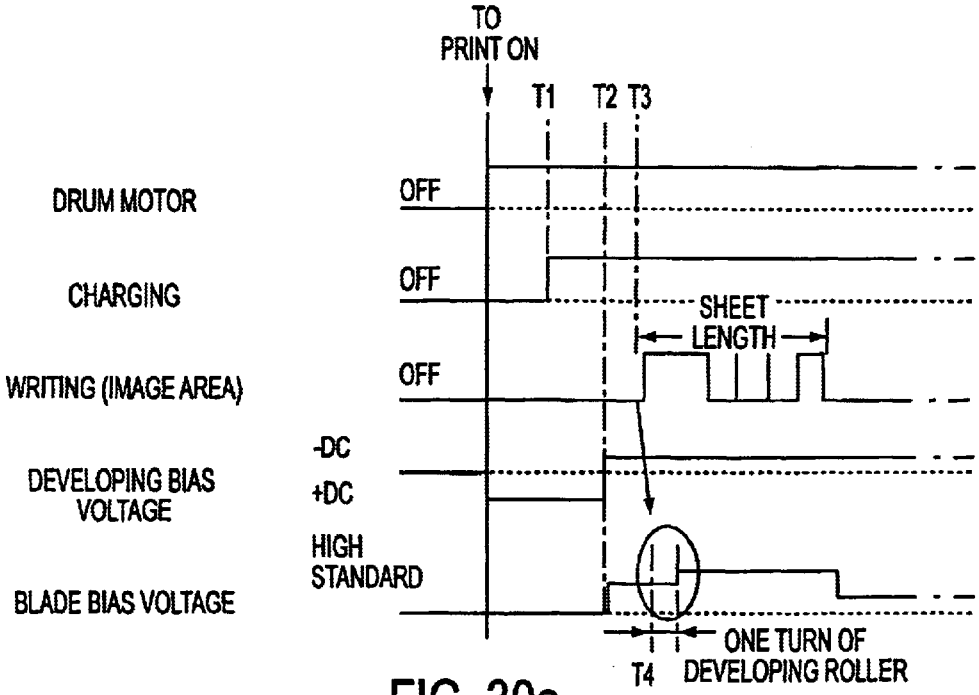
FIG. 30*a* shows timing charts in printing operation of the developing apparatus in case where main image presents at the leading end portion of a sheet of paper.
Figure 30B:
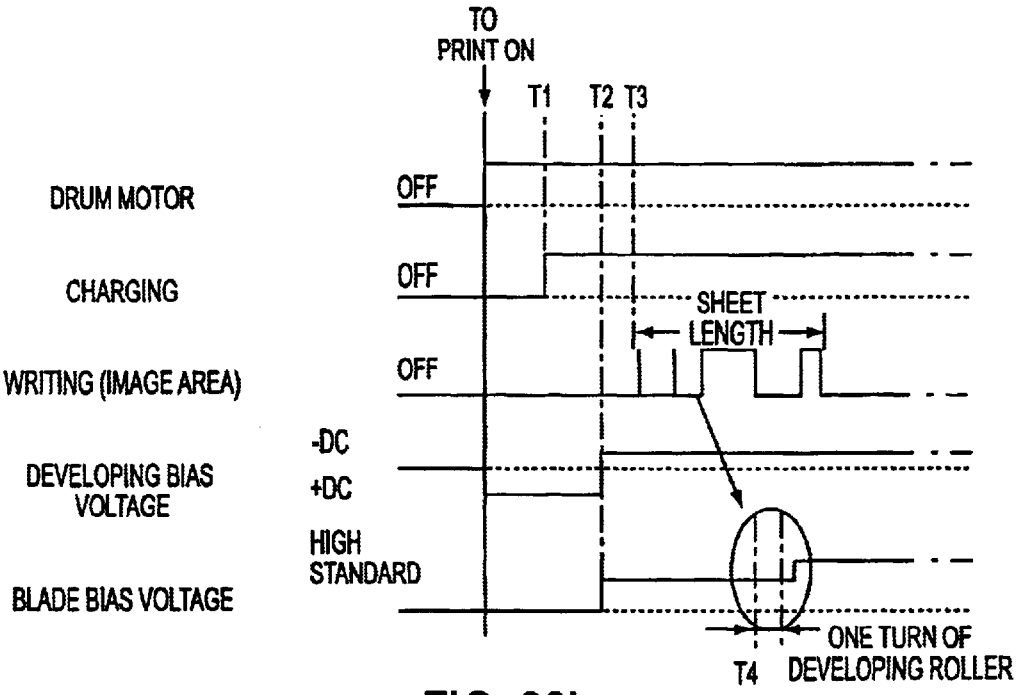
FIG. 30*b* shows timing charts in printing operation of the developing apparatus in case where main image presents around the center of the sheet.

FIGS. 30*a* and 30*b* provide timing charts in printing operation, wherein FIG. 30*a* shows a chart in a case in which main image is present at the leading end portion of a sheet, while FIG. 30*b* shows a case in which the main image is present around the central portion of the sheet. Firstly the case of FIG. 30*a* will be explained wherein the main image is present at the leading end portion of the sheet, for example, when printing a graphic image to be reproduced on the whole plane of the sheet. With printer power turned on to energize the photosensitive drum motor (T0), charging is started (T1) and then developing bias voltage and blade bias voltages are applied (T2), respectively, which is followed by the beginning of writing image portion (T3). In the case of FIG. 30*a*, it is so controlled as seen from the chart that the blade bias voltage is stepped down for a period of time corresponding to one complete turn of the developing roller 5 (T4) after a predetermined length of time has elapsed since the beginning of laser writing (T3), Reference is now made to the timing chart of FIG. 30*b* in the case when the main image is present around the center portion of the sheet. With printer power turned on to energize the photosensitive drum motor (T0), charging is started (T1) and then developing bias voltage and blade bias voltages are applied (T2), respectively, which is then followed by the beginning of writing image portion (T3). In the case of FIG. 30*b*, it is so controlled that the blade bias voltage is stepped down for a period of time corresponding to one complete turn of the developing roller 5 (T4) after a predetermined length of time has elapsed since the beginning of laser write timing reached the central portion on the sheet.

Figure 31:
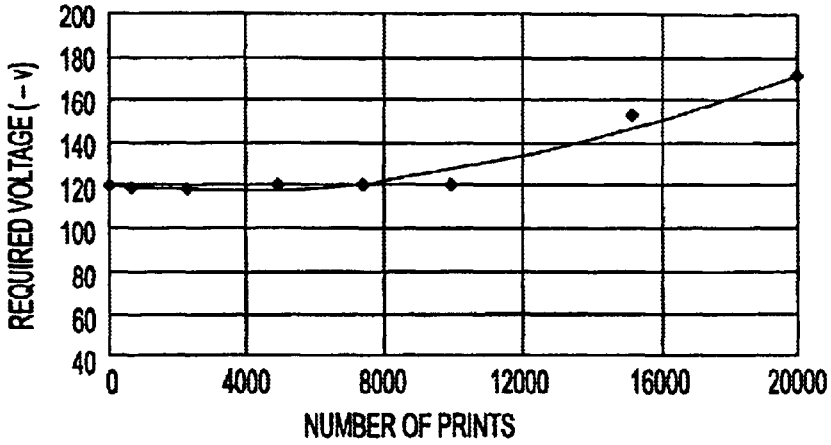
FIG. 31 is a graph showing the magnitudes of voltage by which the blade bias voltage should be stepped up in the second and the following turns of the developing roller for making the toner charge quantities substantially the same in the first turn and in the second and the following turns of the developing roller in making 20,000 prints.

The second method of controllably changing the blade bias voltage so as to make the toner charge quantities substantially the same between the first turn and the second turn et seq. of the developing roller 5 will be explained. FIG. 31 is a graph plotting the magnitudes of voltage to be increased in the second turn et seq. of the developing roller 5 for the above purpose in printing 20,000 sheets of paper. As seen from the graph, a difference of about 120 V is necessary during early printing operation. With an increase in the number of prints, however, the voltage difference should be increased and a difference of about 170 V becomes necessary when 20,000 prints have been made, as shown in graph. This greater voltage difference, as compared with FIG. 28 for the first method, is due to a difference in build-up characteristic of toner chargeability.

In view of the above testing results, printer setting was made such that a bias voltage for application to the toner layer forming blade for a period of time corresponding the second turn et seq. of the developing roller 5 is controllably stepped up form standard voltage by 120 V to 170 V depending on the number of prints then made. Explanation about the manner of controlling and the detailed description thereof with reference to a flow chart will be omitted since they are substantially the same as those of the first controlling method. Explanation about the method of controlling the print start timing will be omitted since it is also substantially the same as that in the first controlling method.

Figure 32A:
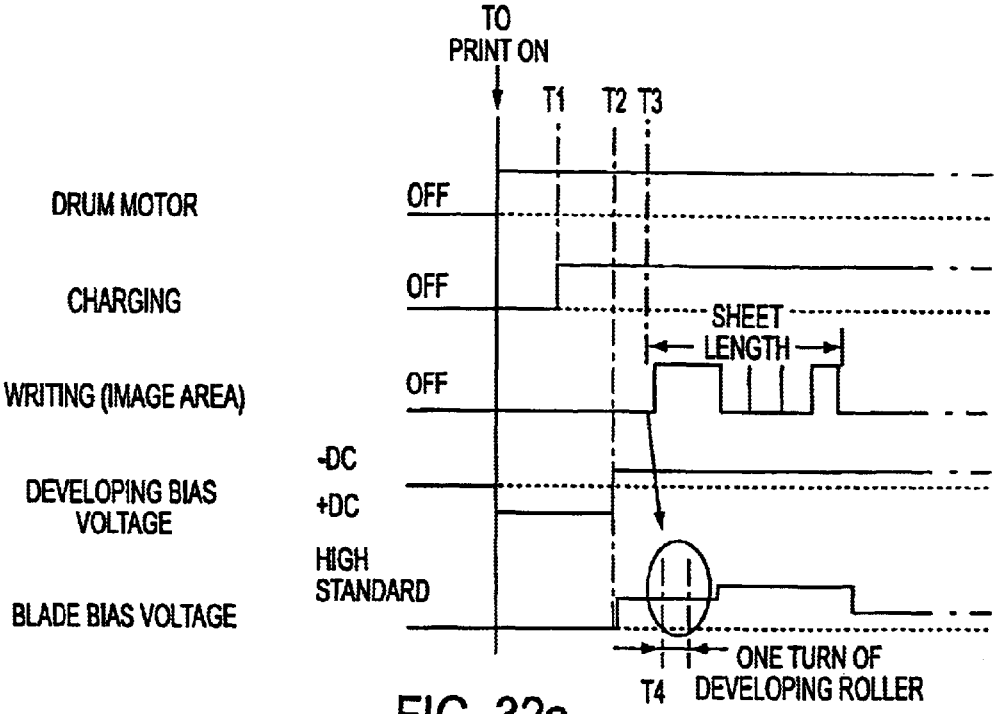
FIG. 32*a* shows timing charts in printing operation of the developing apparatus in case where main image presents at the leading end portion of a sheet of paper.
Figure 32B:
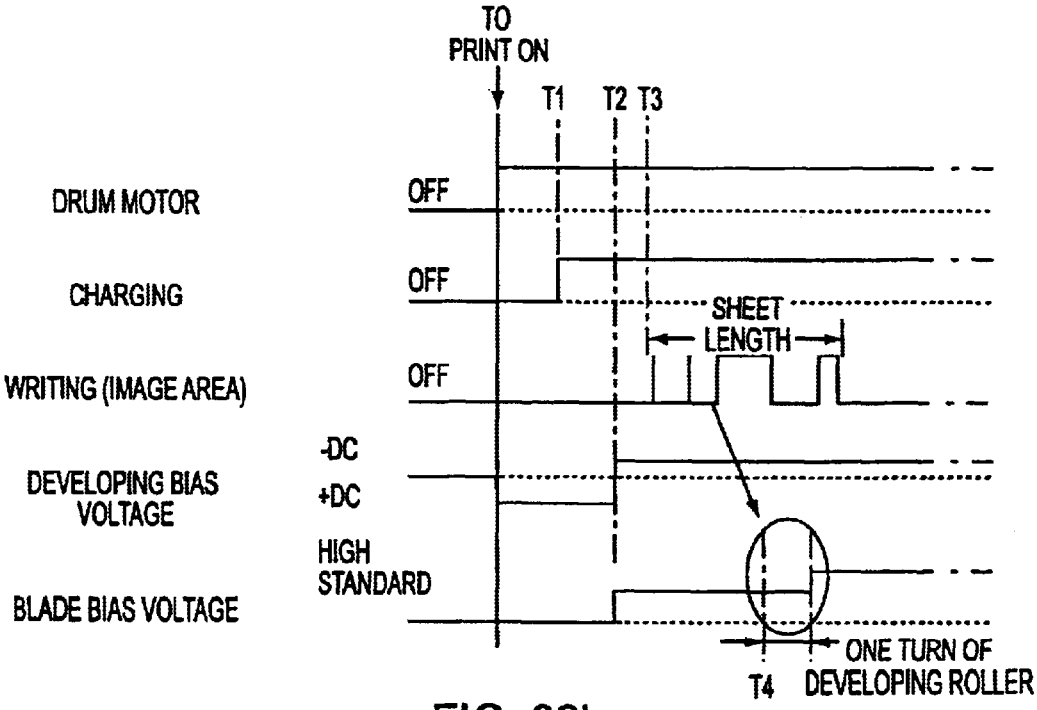
FIG. 32*b* shows timing charts in printing operation of the developing apparatus in case where main image is present around the center of the sheet.

FIGS. 32*a* and 32*b* provide timing charts in printing operation, wherein FIG. 32*a* shows a chart in a case in which main image is present at the leading end portion of a sheet, while FIG. 32*b* shows a case in which the main image is present around the central portion of the sheet. Firstly the case of FIG. 32*a* will be explained wherein the main image is present at the leading end portion of the sheet, for example, when printing a graphic image to be reproduced on the whole plane of the sheet. With printer power turned on to energize the photosensitive drum motor (T0), charging is started (T1) and then developing bias voltage and blade bias voltages are applied (T2), respectively, which is followed by the beginning of writing image portion (T3). In the case of FIG. 32*a*, it is so controlled as seen from the chart that the blade bias voltage is stepped up for a period of time corresponding to the second turn et seq. of the developing roller (T4) subsequent to the first turn thereof after a predetermined length of time has elapsed since the beginning of laser writing (T3).

Reference is now made to the timing chart of FIG. 32*b* in the case when the main image is present around the center portion of the sheet. With printer power turned on to energize the photosensitive drum motor (T0), charging is started (T1) and then developing bias voltage and blade bias voltages are applied (T2), respectively, which is then followed by the beginning of writing image portion (T3). In the case of FIG. 32*b*, it is so controlled that the blade bias voltage is stepped up for a period of time corresponding to the second turn et seq. of the developing roller (T4) subsequent to the first turn thereof after a predetermined length of time has elapsed since the beginning of laser writing (T3). The stepped-up blade bias voltage is resumed to its original standard level after the trailing end of the sheet is detected, and controlling of the blade bias voltage is performed by making use of the timing of laser writing.

Figure 33A:
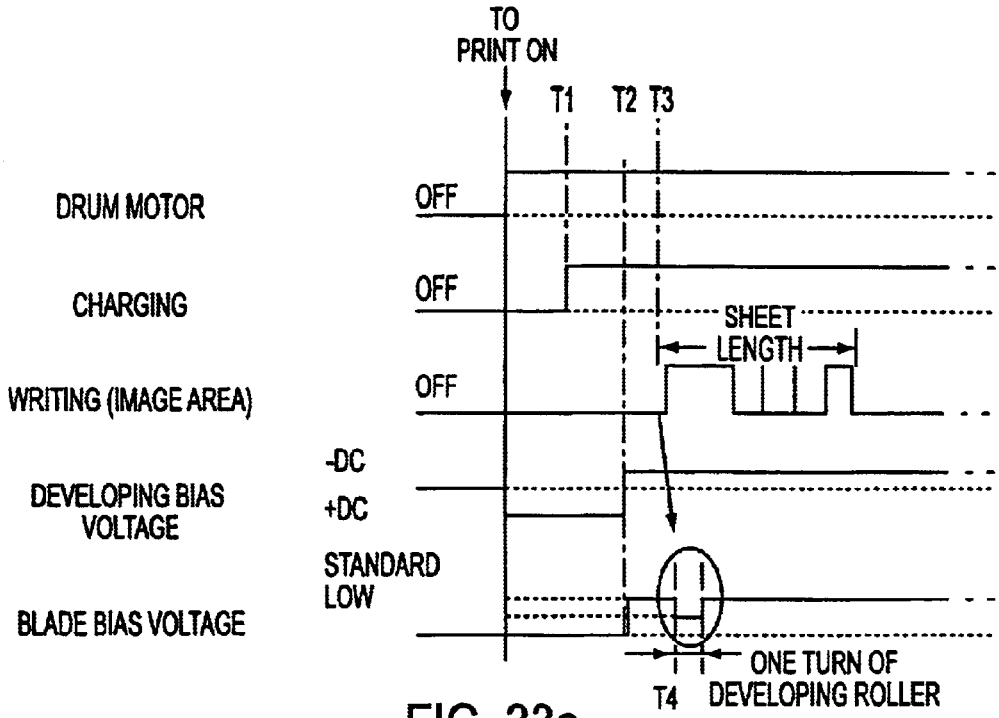
FIG. 33*a* shows timing charts of the developing apparatus in printing operation according to the first controlling method during early stage and after a predetermined number of prints has been made.
Figure 33B:
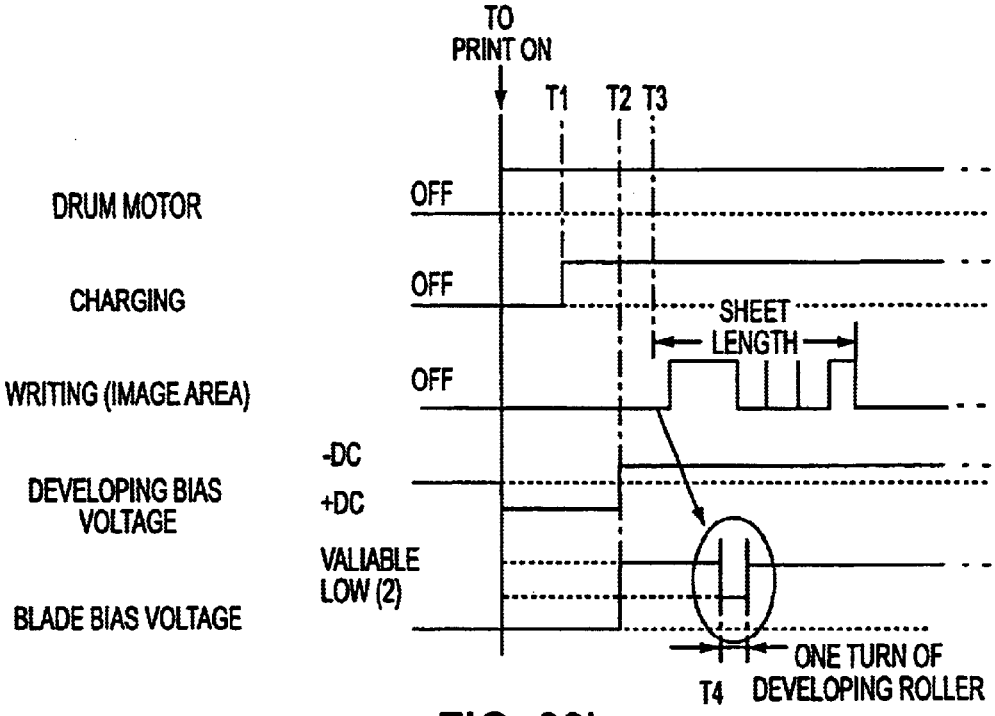
FIG. 33*b* shows timing charts of the developing apparatus in printing operation according to the first controlling method during early stage and after a predetermined number of prints has been made in case where the printer is left in an idle state thereof for about six hours after making 10,000 prints.
Figure 33C:
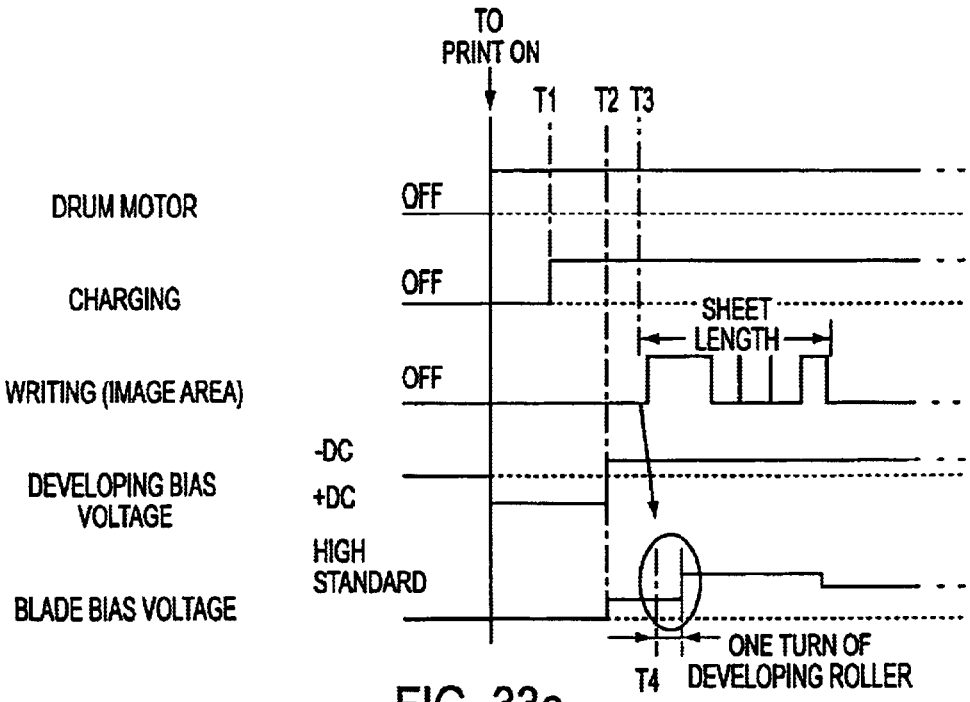
FIG. 33*c* shows timing charts of the developing apparatus in operation according to the second controlling method during early stage and after a predetermined number of prints has been made.
Figure 33D:
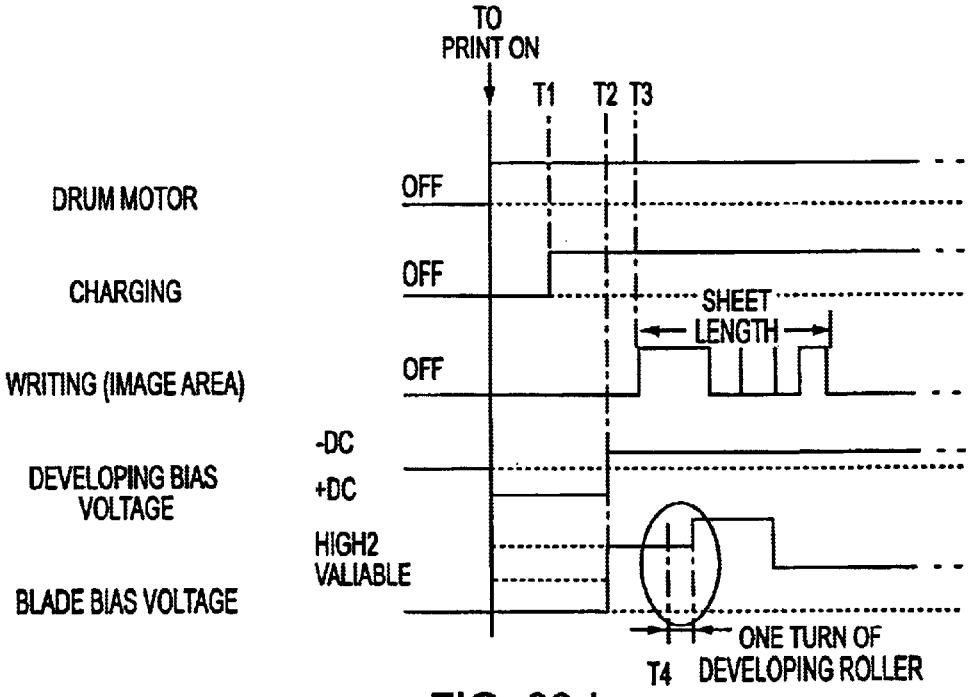
FIG. 33*d* is a timing chart of the developing apparatus in printing operation according to the second controlling method during early stage and after a predetermined number of prints has been made in a case when the printer is left in an idle state thereof for about six hours after making 10,000 prints.

FIGS. 33*a* through 33*d* are timing charts of the developing apparatus in printing operation at an early stage of printing and at a time after a predetermined number of prints has been made, wherein FIG. 33*a* shows a timing chart at an early stage of printing according to the first controlling method, FIG. 33*b* a timing chart at a state where the printer is left unused for about six hours after making 10,000 prints according to the first controlling method, FIG. 33*c* a timing chart at an early stage of printing according to the second controlling method, FIG. 33*d* a timing chart at a state where the printer is left unused for about six hours after making 10,000 prints according to the second controlling method, respectively. As seen from comparison of the charts shown in FIGS. 33*a* through 33*d*, the timing charts for the early stage of printing and for the state where the printer is left unused for a period of time after making a predetermined number of prints are substantially in the respective controlling methods. This means that a printer which is capable of producing prints with a consistent image quality can be provided by making use the aforementioned means and controlling method.

Figure 34A:
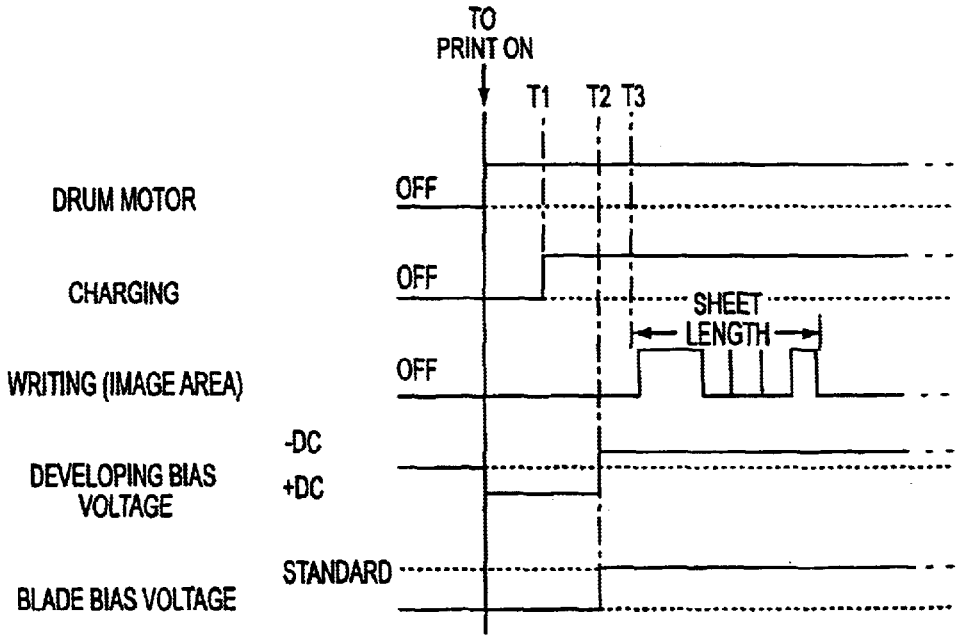
Figure 34B:
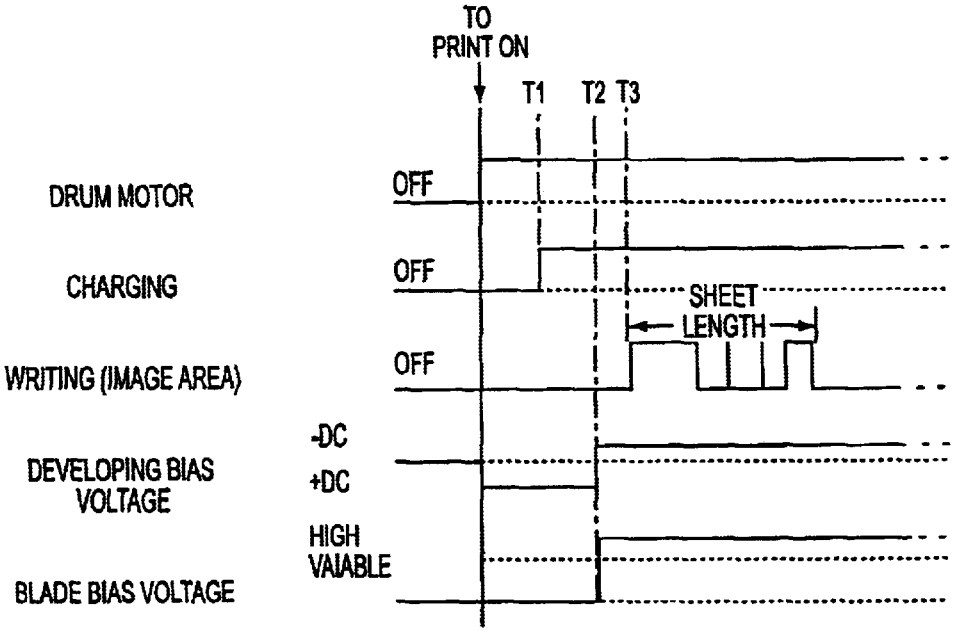
Figure 35A:
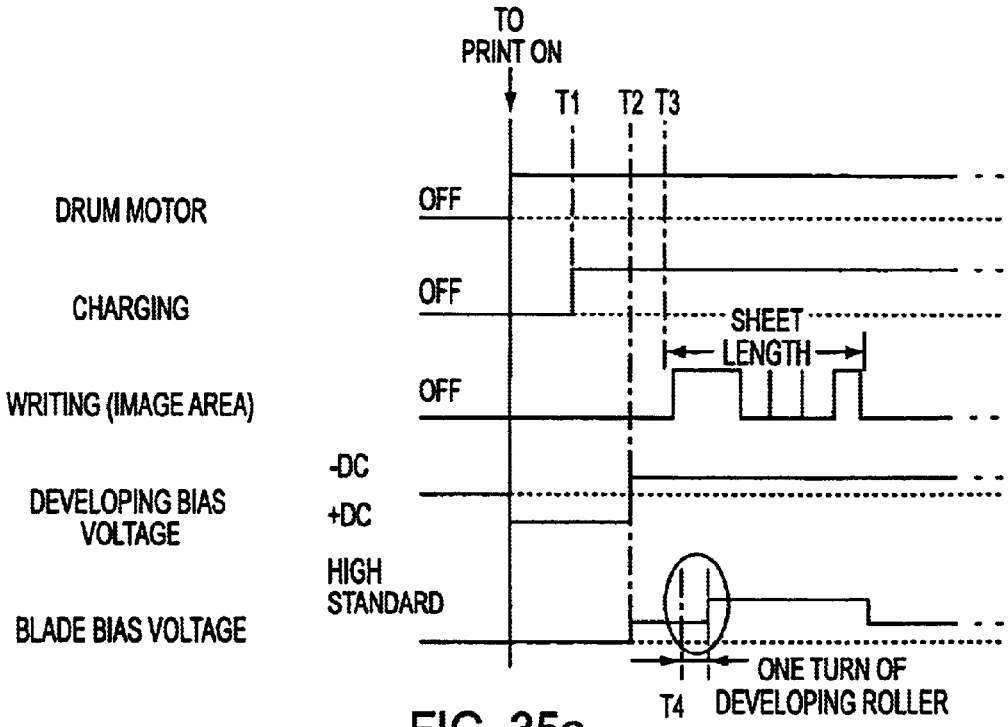
Figure 35B:
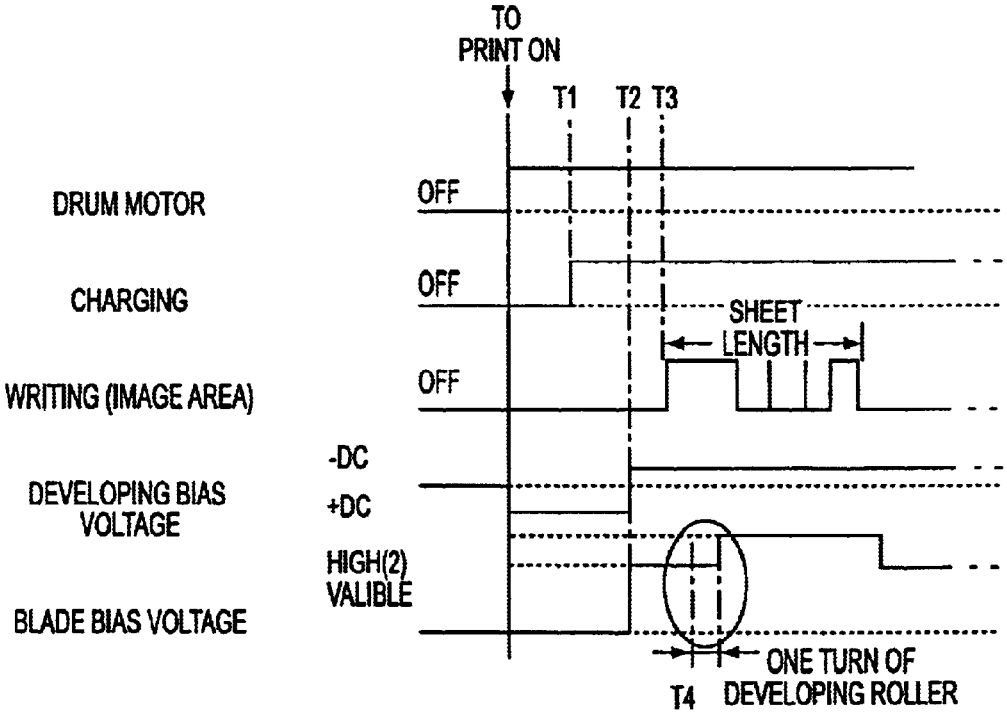

FIGS. 34*a* and 34*b* show timing charts in printing operation according to another embodiment of the invention, wherein the printer has only the function of stepping up the blade bias voltage by a predetermined magnitude after a release of the sleep mode of the fixing device until a predetermined number of prints has been made. In these drawings, FIG. 34*a* shows a timing chart at the early stage of controlling and FIG. 34*b* a timing chart at a state where the printer is left unused for about six hours after making 10,000 prints. On the other hand, FIGS. 35*a* and 35*b* provide timing charts in a case where the printer has only the function of controlling the toner charge quantity during the first turn of the developing roller 5 and the second turn et seq. thereof, wherein FIG. 35*a* shows a timing chart at the early stage of printing operation, and FIG. 35*b* a timing chart at a state where the printer is left unused for about six hours after printing 10,000 sheets.

The printer operable according to the timing control shown in FIGS. 34*a* and 34*b* excludes the function of controlling the toner charge quantity during the first turn and the second turn et seq. of the developing roller 5. Such printer is applicable to a facsimile machine, which produces mainly character images, and in which the quality of graphic image is not a primary concern and, therefore, controlling of the toner charge quantity is not necessarily needed. Therefore, the blade bias voltage is maintained substantially at a constant value.

It is to be noted that the above-described embodiments of the present invention are provided merely as examples and, therefore, the invention is not limited to the illustrated embodiments, but it may be practiced in various changes and modifications without departing from the spirit or scope of the invention. In the apparatus operable according to the timing control of FIGS. 35*a* and 35*b*, for example, the function of stepping up the blade bias voltage by a predetermined magnitude after a release of the sleep mode of the fixing device until a predetermined number of prints has been made (or the apparatus is left in an unused state for a long period of time), this function may be dispensed with if power is turn on or off relatively frequently. If the function of stepping up the blade bias voltage after a long period of unused state is added, the voltage already stepped up from the standard voltage level will be further stepped up for the first turn (T5) of the developing roller 5 and, therefore, the voltage will still further increased after the first turn.

Although the illustrated embodiments employ reversal development process using a photosensitive drum of negative-charge type organic photoreceptor, a photosensitive drum of positive-charge type may be used and the invention is also applicable to development with mono-component nonmagnetic developer using normal development. Furthermore, the bias voltage for application tot the toner layer-forming blade may be varied as required depending on varying conditions. With regard to the structure of normal developing apparatus not covered herein, apparatus of any known type may be used.

It has been explained heretofore that according to the present invention, a mono-component nonmagnetic developing of the type which has its toner layer forming blade applied with a blade bias voltage and which is capable of producing images with consistent quality without being influenced by variation in toner carry quantity and chargeability in response to a life. That is, applying the blade bias voltage in a controllable manner can stabilize toner chargeability, thereby preventing image deterioration by fogging or dust images and contributing to maintenance of consistent image quality with no defects resulting from bias leakage.

For accomplishing such image forming apparatus, there is provided means for applying a bias voltage to the toner layer-forming blade and controllably changing such bias voltage. More specifically, the bias voltage for application to the toner layer forming blade is changed in accordance with the detected electrical resistance of the toner feed roller or the toner carry quantity from the toner feed roller to the developing roller which can be figured out by measuring the running distance of the photosensitive drum. Alternatively, the bias voltage to be applied to the toner layer forming layer is changed controllably between normal imaging forming operation and an operation immediately after releasing the sleep mode of the fixing device of the apparatus.

Additionally, according to the present invention, there is provided means for applying a bias voltage to the toner layer forming blade and the means is operable to controllably change the bias voltage for the distances or period of time corresponding to the first turn of the developing roller as counted from the leading end of a sheet of paper to be formed with image and for the distance or period of time for which the developing roller 5 is turned until the sheet trailing end is reached. This enables an image to be formed with a uniform and consistent density.

What is claimed is:

1. An image forming apparatus comprising:

a photosensitive member for forming thereon an electrostatic latent image;

a developing roller for supplying mono-component nonmagnetic toner to visualize said latent image on said photosensitive member;

a toner feed roller for feeding the toner to said developing roller;

a blade for forming a layer of toner on said developing roller;

a fixing device for fixing said visualized image on an image recording medium; and a blade bias voltage controllable means for applying a bias voltage to said blade and controllably changing the blade bias voltage at a time when a predetermined number of image recording media have been imaged after a start of operation of said fixing device following an idle state thereof continued for a predetermined period of time or longer.

2. An image forming apparatus according to claim 1, characterized in that the blade bias voltage during the period of time before said predetermined number image recording media are formed with images is higher than the bias voltage to be applied to said blade after said period of time.

3. An image forming apparatus according to claim 1, characterized in that the idle state of said fixing device is accomplished by sleep mode setting thereof and the start of operation of said fixing device is effected by terminating the sleep mode setting.

4. An image forming apparatus according to claim 1, characterized by further comprising life-dependent blade bias voltage controllable means for controllably changing a bias voltage for application to said toner feed roller, as well as the bias voltage for application to said blade, in response to a life or an increase in the number of image recording media formed with images.

5. An image forming apparatus according to claim 4, characterized in that the bias voltage for application to said blade is increased with an increase in the bias voltage for application to said toner feed roller.

6. An image forming apparatus according to claim 4, characterized in that the absolute value of the bias voltage for application to said blade is lower than that of the bias voltage for application to said developing roller.

7. An image forming apparatus according to claim 4, characterized in that said life-dependent blade bias voltage controllable means is operable to controllably change the bias voltage for application to said blade in response to the number of turns of said developing roller.

8. An image forming apparatus according to claim 4, characterized in that said life-dependent blade bias voltage controllable means is operable to detect a change in physical characteristics of said toner feed roller based on the value of an electrical resistance thereof and to controllably change the bias voltage for application to said blade based on a change in the electrical resistance value.

9. An image forming apparatus according to claim 4, characterized in that said life-dependent blade bias voltage controllable means is operable to controllably change the bias voltage for application to said toner feed roller and the bias voltage for application to said blade on the basis of an accumulated running distance of said photosensitive member.

10. An image forming apparatus comprising:

a photosensitive member for forming thereon an electrostatic latent image;

a developing roller for supplying mono-component non-magnetic toner to visualize said latent image on said photosensitive member;

a toner feed roller for feeding the toner to said developing roller;

a blade for forming a layer of toner on said developing roller;

a fixing device for fixing said visualized image on an image recording medium; and a blade bias voltage controllable means for controllably changing a bias voltage for application to said blade at a time when said developing roller has made a predetermined number of turns after a start of operation of said fixing device following an idle state thereof continued for a predetermined period of time or longer.

11. An image forming apparatus according to claim 10, characterized in that said predetermined number of turns of said developing roller is one turn.

12. An image forming apparatus according to claim 10, characterized in that the bias voltage for application to said blade during the period of time before said developing roller has made said predetermined number turns is higher than the bias voltage to be applied to said blade after said period of time.

13. An image forming apparatus according to claim 10, characterized in that the idle state of said fixing device is accomplished by sleep mode setting thereof and the start of operation of said fixing device is effected by terminating the sleep mode setting.

14. An image forming apparatus according to claim 10, characterized by further comprising means for detecting the running distance of said photosensitive member and determining the number of turns of said developing roller based on the detected running distance, wherein said blade bias voltage controllable means is operable to controllably change the blade bias voltage based on the determined number of turns.

15. An image forming apparatus according to claim 10, characterized by further comprising life-dependent blade bias voltage controllable means for controllably changing a bias voltage for application to said toner feed roller, as well as the bias voltage for application to said blade, in response to a life or an increase in the number of image recording media formed with images.

16. An image forming apparatus according to claim 15, characterized in that the bias voltage for application to said blade is increased with an increase in the bias voltage for application to said toner feed roller.

17. An image forming apparatus according to claim 15, characterized in that the absolute value of the bias voltage for application to said blade is lower than that of the bias voltage for application to said developing roller.

18. An image forming apparatus according to claim 15, characterized in that said life-dependent blade bias voltage controllable means is operable to controllably change the bias voltage for application to said blade in response to the number of turns of said developing roller.

19. An image forming apparatus according to claim 15, characterized in that said life-dependent blade bias voltage controllable means is operable to detect a change in physical characteristics of said toner feed roller based on the value of an electrical resistance thereof and to controllably change the bias voltage for application to said blade based on a change in the electrical resistance value.

20. An image forming apparatus according to claim 15, wherein said life-dependent blade bias voltage controllable means is operable to controllably change the bias voltage for application to said toner feed roller and the bias voltage for application to said blade on the basis of an accumulated running distance of said photosensitive member.

21. An image forming apparatus comprising:

a photosensitive member for forming thereon an electrostatic latent image;

a developing roller for supplying mono-component non-magnetic toner to visualize said latent image on said photosensitive member;

a toner feed roller for feeding the toner to said developing roller;

a blade for forming a layer of toner on said developing roller;

a fixing device for fixing said visualized image on an image recording medium; and a blade bias voltage controllable means for applying a bias voltage to said blade, controllably changing the bias voltage for application to said blade at a time when a predetermined number of image recording media have been imaged after a start of operation of said fixing device following an idle state thereof continued for a predetermined period of time or longer, and controllably changing the bias voltage for application to said blade about at a time when said developing roller has made a predetermined number of turns after a start of operation of said fixing device following an idle state thereof continued for a predetermined period of time or longer.

22. An image forming apparatus according to claim 21, characterized in that said predetermined number of turns is one turn.

23. An image forming apparatus according to claim 21, characterized in that said blade bias voltage controllable means is operable to increase the bias voltage for application to said blade after said developing roller has made said predetermined number of turns and also to decrease the bias voltage for application to said blade after said predetermined number of image recording media has been formed with image.

24. An image forming apparatus according to claim 21, characterized in that the idle state of said fixing device is accomplished by sleep mode setting thereof and the start of operation of said fixing device is effected by terminating the sleep mode setting.

25. An image forming apparatus according to claim 21, characterized by further comprising means for detecting the running distance of said photosensitive member and determining the number of turns of said developing roller based on the detected running distance, wherein said blade bias voltage controllable means is operable to controllably change the blade bias voltage based on the determined number of turns.

26. An image forming apparatus according to claim 21, characterized by further comprising life-dependent blade bias voltage controllable means for controllably changing a bias voltage for application to said toner feed roller, as well as the bias voltage for application to said blade, in response to a life or an increase in the number of image recording media formed with images.

27. An image forming apparatus according to claim 26, characterized in that the bias voltage for application to said blade is increased with an increase in the bias voltage for application to said toner feed roller.

28. An image forming apparatus according to claim 26, characterized in that the absolute value of the bias voltage for application to said blade is lower than that of the bias voltage for application to said developing roller.

29. An image forming apparatus according to claim 26, characterized in that said life-dependent blade bias voltage controllable means is operable to controllably change the bias voltage for application to said blade in response to the number of turns of said developing roller.

30. An image forming apparatus according to claim 26, characterized in that said life-dependent blade bias voltage controllable means is operable to detect a change in physical characteristics of said toner feed roller based on the value of an electrical resistance thereof and to controllably change the bias voltage for application to said blade based on a change in the electrical resistance value.

31. An image forming apparatus according to claim 26, wherein said life-dependent blade bias voltage controllable means is operable to controllably change the bias voltage for application to said toner feed roller and the bias voltage for application to said blade on the basis of an accumulated running distance of said photosensitive member.

* * * * *